United States Patent [19]

Jeans

[11] Patent Number: 4,520,950

[45] Date of Patent: Jun. 4, 1985

[54] IN-HOME DRINK DISPENSER

[75] Inventor: Edward L. Jeans, Gwent, Wales

[73] Assignee: Cadbury Schweppes Public Limited Company, London, England

[21] Appl. No.: 393,299

[22] Filed: Jun. 29, 1982

Related U.S. Application Data

[63] Continuation-in-part of Ser. No. 140,685, Apr. 16, 1980, abandoned.

[30] Foreign Application Priority Data

Jul. 11, 1979 [GB] United Kingdom ..... 7924162

[51] Int. Cl.[3] ..... B67D 1/04

[52] U.S. Cl. ..... 222/129.1; 137/212; 137/614.04; 222/399; 222/400.7

[58] Field of Search ..... 137/329.1, 614.04, 212; 222/129.1, 129.2, 129.3, 129.4, 394, 396, 399, 146.6, 400.7; 62/389, 430

[56] References Cited

U.S. PATENT DOCUMENTS

| | | | |
|---|---|---|---|
| 2,629,614 | 2/1953 | Valentine | 222/400.7 |
| 3,119,485 | 1/1964 | Bayers, Jr. | 222/129.4 |
| 3,224,641 | 12/1965 | Morgan | 222/146 C |
| 3,250,433 | 5/1966 | Christine et al. | 222/131 |
| 3,266,672 | 8/1966 | Dean | 222/129.1 |
| 3,292,822 | 12/1966 | Crowder et al. | 222/129.1 |
| 3,312,083 | 4/1967 | Scoggins et al. | 62/390 |
| 3,472,425 | 10/1969 | Booth | 222/129.1 |
| 3,578,219 | 5/1971 | Berry | 222/394 |
| 3,578,295 | 5/1971 | Hudson | 261/122 |
| 3,637,197 | 1/1972 | Hudson | 261/122 |
| 3,746,323 | 7/1973 | Buffington | 261/122 |
| 3,790,039 | 2/1974 | Zucconi | 222/394 |
| 3,853,244 | 12/1974 | Neumann | 222/129.1 |
| 4,355,735 | 10/1982 | Whorton et al. | 222/80 |

*Primary Examiner*—F. J. Bartuska

*Attorney, Agent, or Firm*—Kenyon & Kenyon

[57] ABSTRACT

A beverage dispenser particularly adapted for use in the home is disclosed which dispenser includes a source of pressurizing fluid, a dilient tank, dispensing valves and containers of concentrate which are interchangeably insertable in the valves, the flow of pressurizing fluid and diluent conducted through a manifold which is integral with the dispensing valves and the diluent tank and source of pressurizing fluid both being provided with quick disconnect couplings to permit ease of removal and replacement, the elements of the dispenser disposed on a base with the diluent tank and source of pressurizing fluid surrounded by removable covers to provide an attractive, compact and low cost dispensing unit.

73 Claims, 38 Drawing Figures

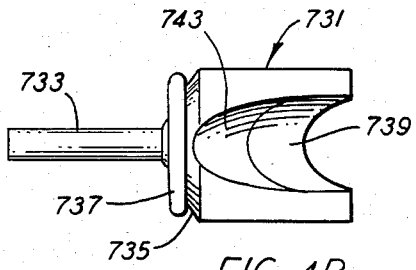
FIG. 4B
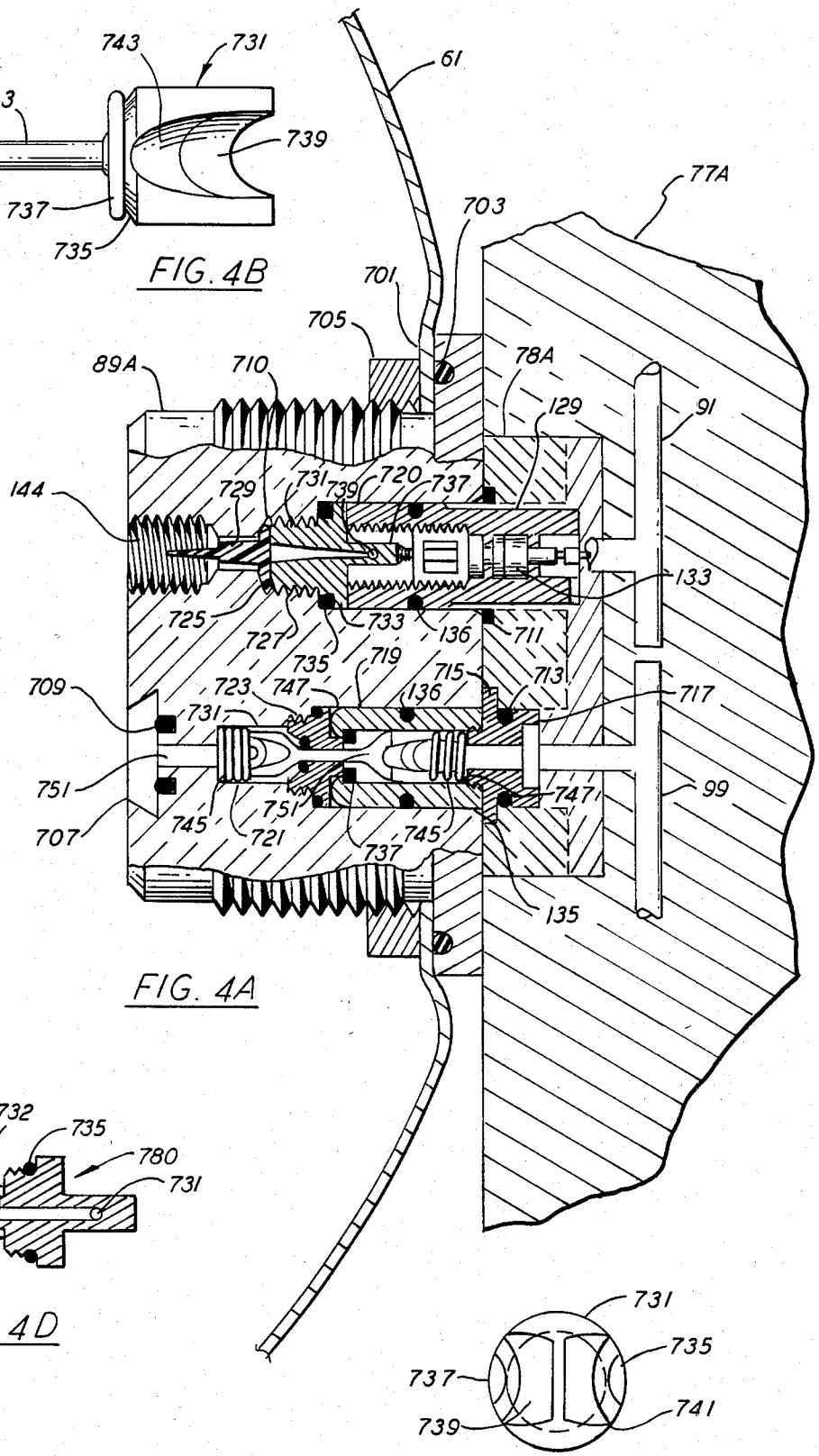
FIG. 4A
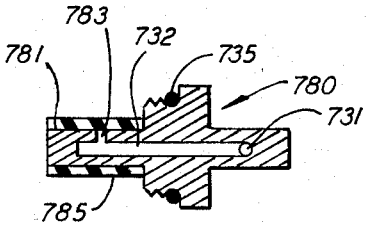
FIG. 4D
FIG. 4C

IN-HOME DRINK DISPENSER

RELATED APPLICATION

This application is a continuation-in-part of application Ser. No. 140,685 filed Apr. 16, 1980 now abandoned.

BACKGROUND OF THE INVENTION

This invention relates to carbonated beverages in general and more particularly to a dispensing device for making carbonated beverages in the home.

Consumers throughout the world consume large quantities of carbonated beverages. Typically, carbonated beverages which are consumed in the home are supplied to the consumer in either cans or bottles. Typically, cans are supplied in 12 ounce sizes and bottles in sizes up to two liters. A carbonated beverage is made up of carbonated water to which there is mixed a juice or syrup. A good tasting beverage requires good water, the proper level of carbonation and the proper proportions between the syrup and carbonated water. Thus, in the commercial production of bottles or cans of carbonated beverages the equipment used includes a carbonator for carbonating the water, a concentrate, i.e., a juice or syrup, dispenser for dispensing the concentrate in the proper quantities and mixing it with the carbonated water, and a filling device for filling the mixed beverage into the bottles. Also included is a chiller unit for chilling the water to be carbonated. Carbonation is carried out by bringing carbon dioxide and water into contact with each other in such a manner that the carbon dioxide dissolves into the water. Typically the water is over carbonated since in the step of dispensing into the bottles or cans, a certain amount is lost. Systems can be operated in which the water and syrup are mixed prior to or after carbonation.

In addition to bottled and canned carbonated beverages, carbonated beverages are also dispensed in restaurants, and at soda fountains and the like. The devices used for such dispensing are known a post mix dispensers and include the same basic elements as one finds in a carbonation plant. In other words, they include means for chilling the water carbonating equipment for introducing carbon dioxide into the water, a juice or syrup dispenser for dispensing metered amounts of concentrate into the water and a tap for dispensing the mixture of concentrate and water into a glass or cup. Typically, mixing of the concentrate and water is carried out at the tap.

Until recently, there has been very little attention given to in-home carbonated beverage dispensers. Typical in-home beverage dispensers known in the prior art were of the type in which the concentrate and carbonated water were separately dispensed. Thus, someone making a drink would have to judge how much syrup to dispense into a given container, dispense that syrup and then add carbonated water. Obviously, a consistent beverage was not obtained. Possibly, because of difficulties in this type of device, in-home dispensers for carbonated beverages never became popular. However, the need for such dispensers should be evident. If, carbonated beverages are purchased in cans, for example, when a can is opened, its contents should be used as soon as possible, since any beverage left over will lose its carbonation. Large recloseable containers to some extent overcome this problem. However, even though these containers are recloseable, after a period of time, their contents will also lose some of their carbonation. Thus, the ability to in effect make carbonated beverages when and in the quantities needed in the home would be of great advantage. However, for an in-home dispenser to be practical, and economically feasible, it must be relatively inexpensive and easy to operate.

In addition to carbonated beverages, large amounts of juices and other fruit drinks and large amounts of hot beverages are also consumed. In many instances, such beverages are also made by mixing a concentrate with a diluent, just as a syrup or other concentrate is mixed with a diluent, e.g., carbonated water to make carbonated beverages. The need for such a dispenser, where in many instances near sterile conditions must be maintained, should also be evident.

With these needs in mind, it is the object of the present invention to provide an economical, efficient dispensing unit for beverages which are made by mixing a diluent with a concentrate in particular for carbonated beverages.

Furthermore, such a dispenser should be capable of easily dispensing any of a plurality of different carbonated beverages such as cola, diet cola, quinine water, orange, rootbeer, beers, sparkling wines, etc. In addition, such a dispenser should also be adaptable to dispensing still beverages such as fruit drinks, juices and wines; and hot in addition to cold beverages. In addition, such a unit should be capable of use in the home.

SUMMARY OF THE INVENTION

The present invention provides such a dispenser, particularly useful as an in-home dispenser. The dispenser of the present invention is particularly compact, made of low cost materials, and designed in a manner such as to minimize the expense, maintenance and the pressures required within the system. The dispenser of the present invention is adapted to be either a self-standing unit which must be periodically refilled with water, or to be a plumbed in unit to which water is supplied from the water mains. In addition, the dispenser of the present invention can optionally include a chilling unit, or alternatively, may be chilled using ice or the type of coolant known as "Blue Ice" commonly used in cooler chests. Because of the flexibility of the design of the dispenser of the present invention a range of embodiments suiting the particular needs and the pocketbooks of various consumers is thus possible.

The dispenser of the present invention contains all of the elements necessary in a carbonated drink dispenser packaged in a particularly compact unit which permits ease of dispensing and ease of interchange of different concentrates to permit dispensing as many different types of drinks desired. The illustrated embodiment has the capability of containing two separate concentrate containers at one time. However, as will be evident below, the exchange of containers is particularly simple and straight forward, thus permitting the dispensing of many different types of drinks without a great deal of effort. This is accomplished primarily through the use of a unique container design which is the subject of application Ser. No. 314,488 filed on Oct. 9, 1981. Basically, the container is constructed with built in valving means for dispensing the syrup. The container cooperates with a valve, a rotary valve in the disclosed embodiment, which acts to carry out the functions of venting the concentrate container, supplying a pressurizing gas, e.g., carbon dioxide under pressure, to the concentrate container for dispensing, and of controlling the valve built into the container for the dispensing of concentrate. The design of the container and valve is such that mixing occurs only outside the dispenser, which mixing is of an intimate nature producing an excellent drink. Furthermore, through this design dilute concentrate exists only in the drinking vessel thereby preventing the formation of mold on the unit. Both the container and the rotary valve assembly are preferably made of plastic, thereby facilitating molding of the various parts.

As noted above, the dispenser of the present invention can be free-standing or connected to water lines. It is thought that a free-standing unit is more attractive to consumers at this time and for convenience, the carbonator should be capable of being removed. A number of alternate carbonators are possible for use with the present invention. However, in a free-standing unit which must be periodically refilled with water, the simplest type of carbonator, a sealed vessel to which pressurized carbon dioxide is supplied through a diffuser within a body of water contained in it, can be used. Thus, the system includes a pressure vessel for the water and includes means for admitting carbon dioxide under pressure to the diffuser from which it bubbles through the water, any carbon dioxide not absorbed remaining in a head space above the water.

Since this container is normally pressurized, it is necessary that safety features be provided to prevent danger to the user at the time of refilling the water container. Furthermore, it is preferred that the water container be removeable for such purposes. In accordance with the present invention the carbonator contains a number of features to facilitate its removal and refilling in a safe manner. This includes a design of cover for the carbonator which is easy to use and prevents removal of the cover until pressure within the carbonator is released. This is accomplished by latching a relief valve in place as the cover is screwed on. The latch of the relief valve constitutes a stop preventing turning of the cover until pressure is released. Furthermore, a unique sealing arrangement of the cover is provided in which sealing occurs between the circumferential portions of the container and the cap so that it is not necessary that the cap be turned all the way in to insure pressure tightness.

Since normally, during operation, the carbonator is connected to a supply of carbon dioxide, means must also be provided to permit such connection to be quickly made and disconnected. Thus, the dispenser of the present invention also includes a quick release connection for the carbonator which contains appropriate valving means to shut off the carbon dioxide supply as the carbonator is removed from the dispenser, and, at the same time, the water supply from the carbonator is disconnected. Since it is necessary that when the carbonator is in place it be held in contact with the quick release connection supplying the carbon dioxide, a special design of the handle including pin for retaining the carbonator in place is provided. The handle on the carbonator is a folding handle which when folded into place inserts a pin into a base member on which the carbonator sits, holding the carbonator in place against the connecting block containing carbon dioxide and water supply ports. When the handle is extended to remove the carbonator the pin is removed from the base member permitting the carbonator to be pulled away. In accordance with an alternate embodiment of the present invention the carbonator is vertically mounted on the quick release connection thereby insuring proper contact by means of its weight.

As noted above, carbon dioxide is absorbed in water better when the water is chilled. Two possibilities for chilling of the water are provided. In accordance with one embodiment, thermoelectric chilling devices are provided with the carbonator resting on an assembly made of such. As an alternative, the carbonator rests on a cooling container which may contain a coolant commonly known as "Blue Ice". The container may be placed in the freezer, frozen and then inserted under the carbonator. Additional cooling may be obtained by either placing the carbonator, with water therein in a refrigerator overnight, and/or the placing of ice within the carbonator.

The system also includes a carbon dioxide bottle which is provided with a regulator. Within the system, two separate pressures are required, a higher pressure for carbonating the water and for driving the carbonated water to the tap, and a lower pressure for pressurizing the concentrate container. Thus, two stages of regulation are required. Furthermore, the gas at the various pressure and the carbonated water must be transferred throughout the system. Typically, in existing dispensers, such is accomplished by tubes and hoses. However, in accordance with the present invention a unique manifold design is provided which permits carrying out essentially all of the distribution of materials using a single manifold block. Only a single tube connection between the manifold block and the carbon dioxide cylinder is required. Carbon dioxide from the cylinder which is regulated down to a pressure of 40 psi is supplied to the manifold which distributes it to the quick disconnect coupling to the carbonator. The quick disconnect coupling is a unit built into the carbonator which plugs into the manifold. Also, within the manifold is a regulator which reduces the pressure of 40 psi to 5 psi for use in pressurizing the concentrate container. The manifold, through the quick disconnect coupling, also conducts the carbonated water from the carbonator to the dispensing tap.

Although the rotary valve used for dispensing can be made as a separate unit to plug into the manifold, obtaining therefrom the carbonated water which it is adapted to dispense, and the low pressure carbon dioxide which it is adapted to supply to the concentrate container, in accordance with the preferred embodiment, the manifold and rotary valve are made into a single compact unit, further simplifying the construction of the dispenser. Because the length of the runs are short within the manifold, pressure drops are small and as the concentrate is not required to flow within tubes a low pressure of 5 psi is all that is required for pressurizing the concentrate container. In prior art devices, pressures of 40 psi have been typically used for this purpose.

The total unit is disposed on a base and is enclosed by a plastic cover designed to allow easy heat evacuation. It is particularly compact, attractive, sanitary and inexpensive.

Although the dispenser of the present invention is disclosed primarily as a unit for dispensing carbonated beverages and also as an in-home dispensing unit, it is not limited to such functions. Obviously, as will become evident, the dispenser, with appropriate modification, can also be used in restaurants, soda fountains and the like. Furthermore, in addition to dispensing carbonated beverages in which carbonated water is mixed with a concentrate such as a flavoring syrup, quinine concentrate or the like, the apparatus of the present invention may also be used for dispensing still beverages and for dispensing hot beverages. In other words, it is generally adaptable to dispensing any beverage in which a concentrate is mixed with a diluent. The diluent need not be still water or carbonated water although in most cases it will. As alluded to above, by disposing the metering valve for the concentrate within the package and disposing the package above the dispensing valve, the concentrate need not touch any part of the dispensing apparatus. What this means is that dilute concentrate which, particularly when it is something like a nutrient containing syrup, can encourage in the growth of mold, never exists within the machine. This maintains sanitary conditions. Furthermore, the container is particularly adapted to filling in a near sterile condition which may be of particular importance with respect to some types of hot and still drinks. In operation, when pressurized by a pressurizing gas, which could be an inert gas such as nitrogen, where carbonation is not desired, the gas may be used to maintain near sterile conditions and to prevent oxidation and maintain flavor integrity in the apparatus over periods of time. In such a case, this pressurized gas could, of course, also pressurize the diluent supply. In other words, the various features of the present invention which give it its simplicity and compactnes will be of advantage in dispensing other types of beverages, i.e., still cold and hot beverages, in addition to cold carbonated beverages. For example, the quick disconnect connection of the water supply, the manifold design, the valve and container design each will perform the same functions and give the same advantages.

BRIEF DESCRIPTION OF THE DRAWINGS

FIG. 4*a* is a drawing illustrating an alternate form of valving at the connection between the manifold and carbonator.

FIG. 4*b* is a side elevation view of a valve core used in the water valves of FIG. 4*a*.

FIG. 4*c* is a bottom view of the valve core of FIG. 4*b*.

FIG. 4*d* is a cross sectional view of another alternative form of valving at the connection between the manifold and the carbonator.

DETAILED DESCRIPTION OF THE INVENTION

The present invention will be described in detail in connection with an in-home dispensing unit particularly adapted for carbonated beverages. However, the various aspects of the present invention are also useful in other environments, such as in restaurants, soda fountains, etc. Furthermore, in addition to being useful for preparing carbonated drinks, the dispenser of the present invention can also be used for making still drinks, for example, for mixing a fruit juice concentrate with water to make a juice, and also for making hot drinks by mixing hot water with a suitable concentrate.

Figure 1:
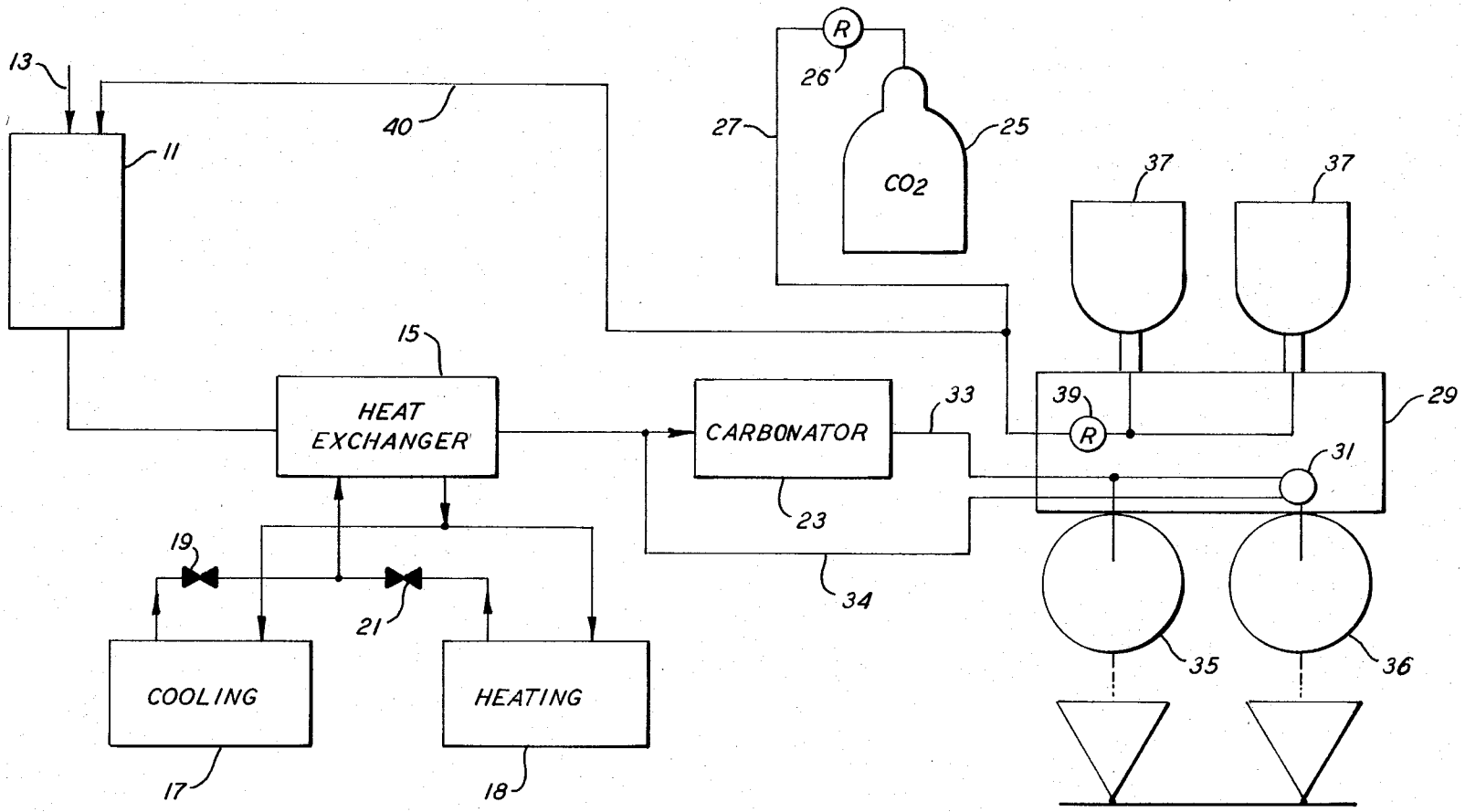
FIG. 1 is a block diagram of the dispensing system of the present invention.
Figure 2A:
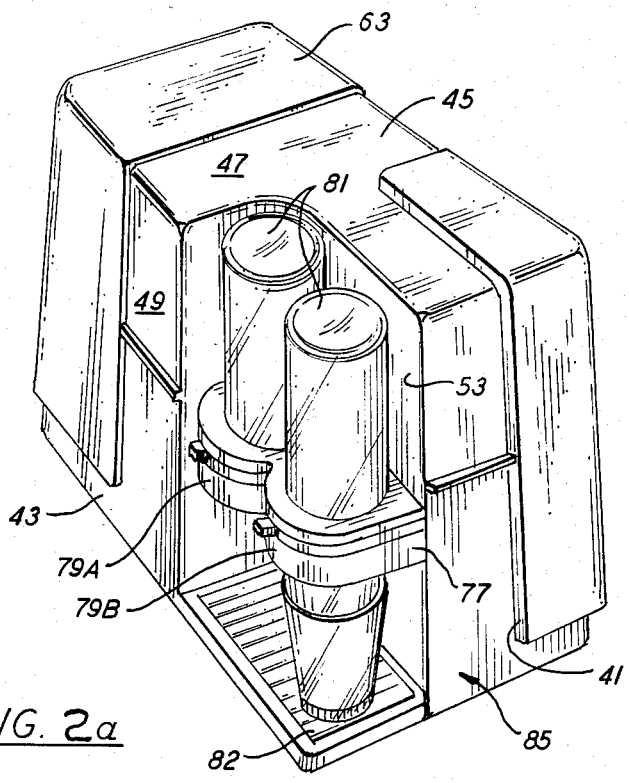
FIG. 2*a* is a front perspective view of a dispenser according to the present invention.
Figure 2B:
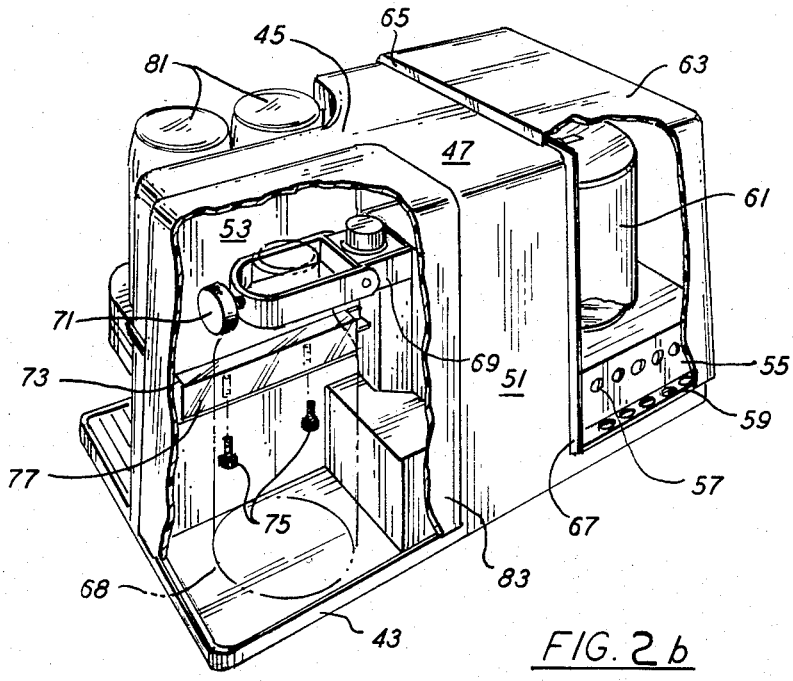
FIG. 2*b* is a rear perspective view of the dispenser of FIG. 2*a*.

Thus, FIG. 1 is a generalized block diagram of a system according to the present invention. The system includes a water source 11. In more general terms, this is a source of diluent which is later mixed with a concentrate. Although it will, in most cases, be water, other diluents might be used. Shown in connection with the water source is an inlet 13. The inlet 13 may be an inlet which is plumbed into the plumbing of the location where the dispenser is used or may simply be an opening in the water tank which permits refilling. The water from the water source is shown passing through a heat exchanger 15. Shown associated with the heat exchanger 15 is a cooling unit 17 and a heating unit 18. Cooling can be supplied to the heat exchanger 15 by opening a valve 19 and heating by opening a valve 21. In many instances, the heating or cooling will be associated directly with the water source or water tank 11. In general terms, the heat exchanger 15 and associated cooling 17 and 18 simply comprise means for adjusting the temperature of the diluent.

At the outlet of the heat exchanger 15 is a carbonator 23. Carbonator 23 is supplied with carbon dioxide from a tank 25 through a reducing valve 26, a line 27, and a manifold 29. When in use carbonated water is supplied over line 33 to the manifold 29. The manifold 29 supplies this water or other diluent to dispensing valve 35 in accordance with the present invention. Still water is supplied over a line 34 to a mixing valve 31 at the manifold. Mixing valve 31 has a second inlet supplied with carbonated water from line 33 and permits supplying to a dispensing valve 36 any desired proportion or mixture of still and/or carbonated water. Also located at the dispensing valves 35 and 36 are containers 37 filled with a concentrate which is to be mixed with the diluent. As will be more fully described, the metering valve for concentrate is in the container 37 and is coupled to and cooperates with the dispensing valves 35 and 36. That is, the container 37 with the concentrate includes valving means to meter the amount of concentrate in response to a relative movement of two parts of a container brought about by the dispensing valves 35 and 36. The supply of carbon dioxide over line 27 is also used to pressurize the concentrate in the container 37 after being coupled through a reducing valve 39. Also shown is a line 40 coupling carbon dioxide to water source 11 to supply the diluent at a constant pressure. As with the means for changing the temperature of the diluent the carbonator may also be built into the water container as is the case in the embodiment to now be described. In that case, water source 11 is also the carbonator. Furthermore, although carbon dioxide is shown as the pressurizing gas, in embodiments where carbonation is not desired, it may be replaced by any inert gas such as nitrogen.

The Dispensing System

The embodiment of the dispenser of the present invention illustrated in perspective view in FIGS. *2a* and *2b* includes a supporting structure 41 which is preferably of molded plastic. Structure 41 includes a base 43 and an upstanding T-shaped portion 45. The T-shaped portion 45 includes a top wall 47 front and rear walls 49 and 51, respectively, and a central divider 53. At the one end of the unit, as best seen in FIG. *2b*, mounted to the base 43 is a cooling unit 55. Shown in the cooling unit 55 are ventilation openings 57 which communicate with additional ventilation openings 59 formed in the base 43. Disposed atop the cooling unit 55 is a diluent tank, e.g., a water supply and carbonator tank 61 to be described in more detail below. Surrounding this portion of the unit is an insulated cover 63 which has a depending flange portion 65 which engages corresponding lip 67 on the central portion 45. As will be described in more detail below, the carbonator is adapted to be easily removed and refilled with water when necessary. As an alternative to a cooling unit 55, a heating unit, or combined heating and cooling unit, can be provided to permit the possibility of dispensing either cold or hot drinks.

At the other end of the dispensing apparatus, supported on the base 43, is a tank of a pressurizing gas, e.g., a carbon dioxide tank, 68 shown in the phantom. The carbon dioxide tank 68 is connected to a reducing valve 69 by means of a quick disconnect clamp 71 to permit ease of replacement of the carbon dioxide bottle 68. Extending through the dividing wall 53 and secured to a bracket 73 thereon by means of screws or bolts 75 is a manifold 77 which will be described in detail below. The manifold 77 distributes the pressurizing gas and diluent, e.g., carbon dioxide and carbonated water. The front portion of the manifold 77 is visible on FIG. *2a*. Integral with the manifold are two dispensing valves 79A and 79B to be described in detail below. Disposed above each of the dispensing valves 79A and 79B is a container 81 containing therein a concentrate to be mixed with the diluent supplied from the diluent tank 61. Below valves 79A and 79B is a removable tray 82 retained magnetically, for example, for catching any spillage. Tray 82 may be removed and rinsed periodically. Again, although disclosed hereinafter as supplying carbonated water, it will be recognized that, by disconnecting the carbonator apparatus, still beverages can be dispensed, and, by heating instead of cooling the diluent, hot drinks can also be dispensed. As will become more evident below, the containers 81 are particularly adaptable to packaging and storing all types of concentrate in a sanitary manner.

Covering the carbon dioxide tank 68 is a second cover 83, which similarly has a depending flange 85 engaging a lip on the T-shaped central structure 45.

Figure 3:
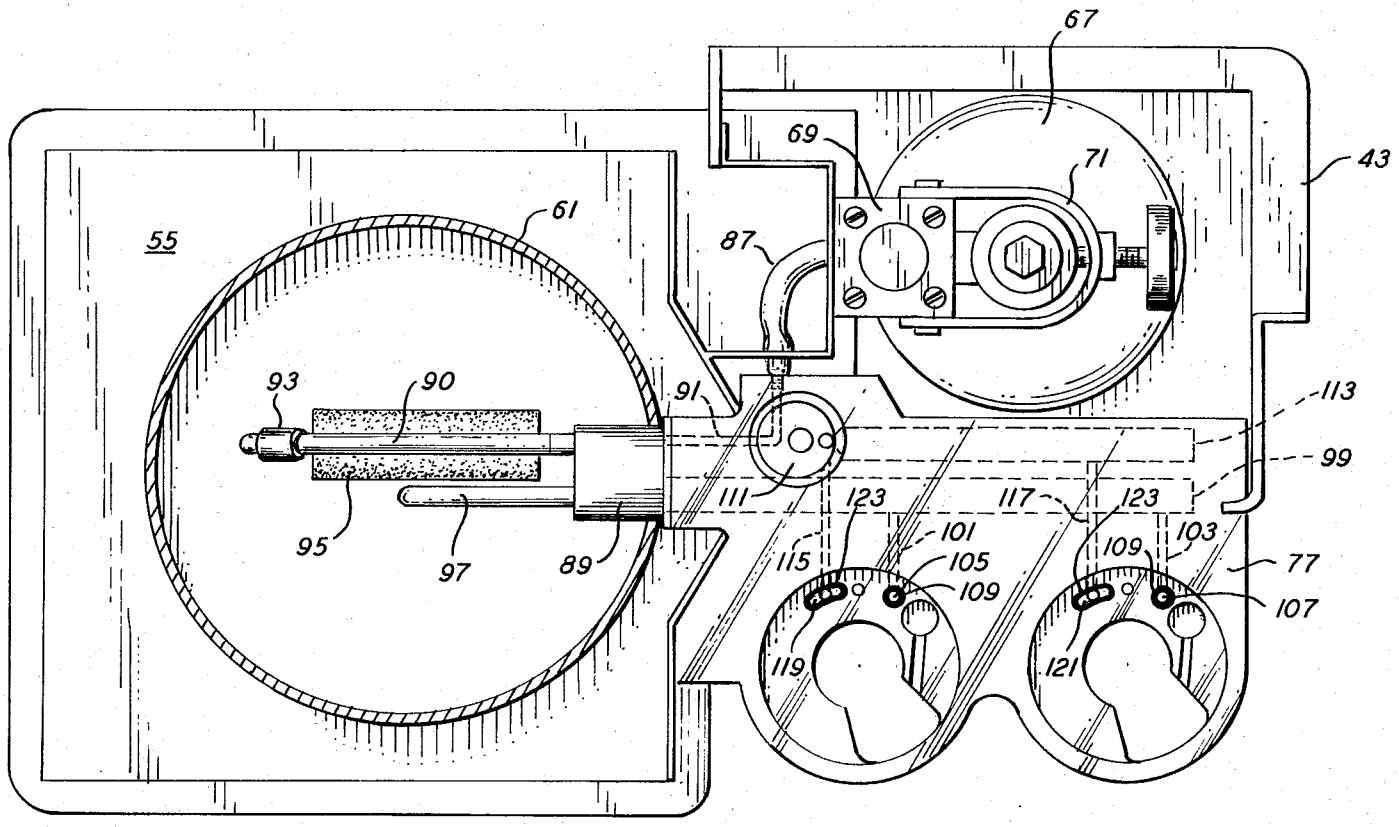
FIG. 3 is a plan view of the dispenser according to FIGS. 2*a* and 2*b*.

FIG. 3 is a plan view of the dispenser of FIGS. *2a* and *2b* with the covers 63 and 83 removed and the T-shaped center section 45 also removed for clarity of presentation. In this view, the $CO_2$ bottle 68 is visible together with its quick disconnect clamp 71 and pressure regulator 69. The pressure regulator is semi-rigidly mounted and coupled by tubing 87 to the manifold 77. Portions of valves 79A and 79B which are molded integrally with the manifold are also shown. Also shown in cross section is the carbonator tank 61. The carbonator tank contains a coupling 89 which permits a quick disconnect with the manifold 77.

Pressure regulator 69 reduces the carbon dioxide pressure to 40 psi. $CO_2$ at this pressure is fed through a passage 91 in the manifold 77 to the disconnect coupling 89. From that point it flows through tubing 90 to a restrictor 93, and thence to a diffuser 95. Carbonated water is removed from the carbonator tank through a line 97 extending to the bottom of tank 61 and leading to the coupling 89 whence it enters a passage 99 in the manifold. This passage connects with two smaller passages 101 and 103, which lead to outlets 105 and 107, in the portion of the valves which is integral with the manifold. At each of the outlets an O-ring seal 109 is provided. Carbon dioxide is also fed through a further pressure regulator 111 which is built into the manifold 77, where the pressure is reduced to 5 psi. From regulator 111 the carbon dioxide flows in a passage 113 to which are connected two passages 115 and 117, which lead to elongated openings 119 and 121 in the portion of the manifold which comprises part of the valve. Again, in each case an O-ring seal 123 of neoprene or the like is inserted. Although the manifold can be made of various materials, a plastic is preferred. With such plastic the manifold can be molded and any necessary machining carried out to form the various passageways.

The Manifold

Figure 4:
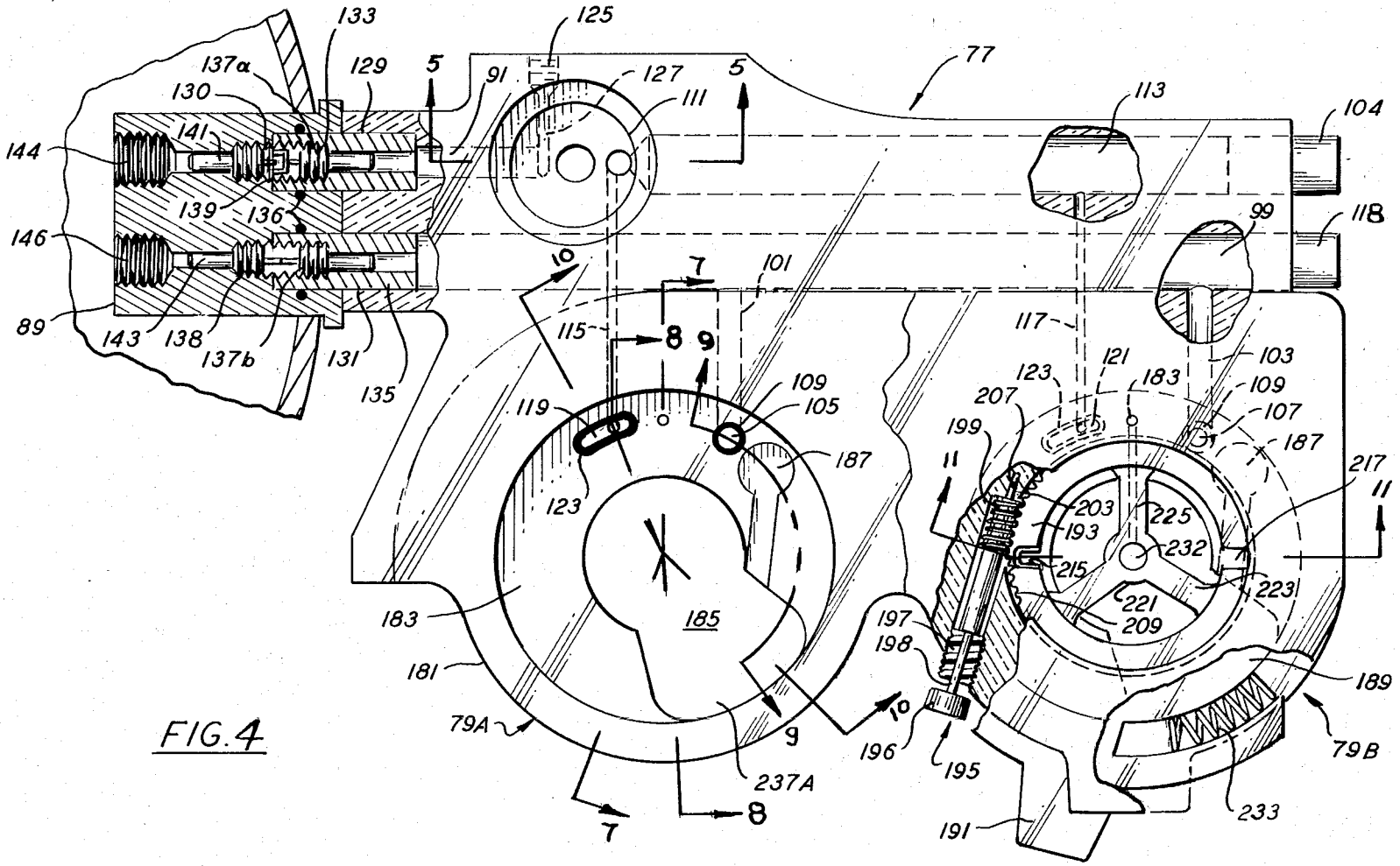
FIG. 4 is a plan view of the valve of FIG. 15, partially cut away showing the valve integral with a manifold.

The manifold 77 and the dispensing valves are shown in more detail in FIG. 4. At the inlet for carbon dioxide, a threaded fitting 125 is provided in the manifold. As illustrated, this communicates with a channel 127 which is connected directly to the passage 91. This is seen in more detail in FIG. 5 which is a cross section through the pressure regulator. Inserted into appropriate bores 129 and 131 on the left side of the manifold 77, are tubular fittings 133 and 135. These are press fitted into their respective bores 129 and 131. Each contains, threaded therein, a check valve, e.g., a Schrader type valve 137*a* and 137*b* respectively. The fittings 133 and 135 insert into the quick disconnect coupling 89 in the carbonator tank 61 and are sealed by O-rings 136. Within a bore 130 in the coupling 89, mating with the fitting 133, is disposed an anvil 139 followed by a check valve 141 which is blown open by $CO_2$ pressure from line 91. In a bore 138 of the coupling 89 which mates with the fitting 135 is inserted another Schrader valve 143. The valve 143 abuts against the valve 137*b* opening both valves when the quick disconnect coupling 89 is attached to the manifold. Similarly, the anvil 139 opens the valve 137*a*. In this manner, when the carbonator is disconnected from the manifold, there is a check valve in both passages of the manifold and in both passages into the carbonator to prevent release of pressure. The coupling 89 also contains, at its inside, threaded bores 144 and 146 for connecting lines 90 and 97 of FIG. 3.

FIG. 4*a* shows an improved form of valving. Although the valving of FIG. 4 is operable, the valving illustrated in FIG. 4*a* provides superior performance. Tests with the type of valving shown in FIG. 4 showed that it gave an undesirable flow restriction in the water outlet and the presence of sharp edges resulted in energy dissipation and de-gassing. With respect to the gas side, it was discovered that a pressure-activated check valve would give superior performance to a Schrader valve of the type illustrated in FIG. 4.

Referring to FIG. 4*a*, in the illustrated embodiment the valve block 89A which is mounted to the diluent tank 61 is, in this embodiment, a molded plastic part of Lucite or the like rather than the stainless steel part of FIGS. 3 and 4. It is secured in place in an appropriate opening in the tank 61 at a flat area 701 thereof by means of a sealing gasket 703 on one side and a lock ring 705 on the other side. Block 89A contains a threaded portion 144 for connection of a diffuser as previously. On the outlet side, it contains a slotted portion 707 with an internal O-ring seal 709 for insertion of a resin bed. A resin bed of the type which can be used with the present invention is disclosed in co-pending application Ser. No. 310,486 filed Oct. 9, 1981 and assigned to the same assignee as the present invention. As in the previous embodiment, fittings 129 and 135 are inserted into the manifold 77A in communication with lines 91 and 99, the gas and water lines respectively. For reasons which will be apparent below, fitting 135 is made of two parts, 719 and 717 which screw together. Part 717 is the one press-fitted into the manifold 77A. O-ring seals 711 and 713 are provided for sealing purposes.

Inserted into the resting on the base of the bore 725 is the flange of a duckbill valve 729. It is held in sealing contact by a member 731 made of stainless steel screwed into the threads 727. Member 731 contains a flange 733 pressing against an O-ring 735 placed at the base of the bore 720. Extending from the flange is a pin 737 having a cross-bore 739 therein. This communicates with a central bore through the member 731 which communicates with the duckbill valve. The pin 737 acts against the schrader valve 133 which is as in the previous embodiment. Rather than utilizing a duckbill valve, a ball and spring check valve could equally well be used. The key requirement is that the valve be one operated by the gas pressure to open and that it act as a check valve to be closed against pressure from inside the carbonator.

Another alternative to the duckbill valve is the sleeve valve illustrated by FIG. 4*d*. This arrangement takes the place of not only the duckbill valve but also member 731 which holds the duckbill valve in place. In effect, a member 780 of design similar to member 31 has a portion 781 extending below the threaded area. Central bore 732 extends through this portion 781 with flow controlled, both in this case and the previous case, by the size of the opening 731 of the cross bore. Again, an O-ring 735 is provided for sealing. Valve action is accomplished by means of a radial port 783 extending to the circumference of the extension 781 and an elastic sleeve of water resistant material, preferably silicone rubber, covering the extension 781.

On the water side, in the manifold and in the coupler 89A, a type of valve which gives adequate flow, has smooth surfaces and which does not contribute to energy dissipation or degassing is used. FIG. 4*b* is an elevation view and FIG. 4*c* an end view of the type of valve generally indicated as 731 used at these locations. The valve includes a stem 733 of cylindrical cross-section. The stem extends from a conical section 735. The conical section is shown in abutment with an O-ring 737 to demonstrate the nature of the seal made by the valve. In operation, lifting away from the O-ring 737 by movement of the stem 733 opens the valve. The conical shape 735 provides self-centering. From the view of FIG. 4*c*, the base of the conical section 735 is visible. The location of the O-ring seal 735 seated thereon is also visible. As illustrated, there are angled two semi-circular cuts made on each side of the valve core. Thus, from the botton view, one can see the cuts 739. These terminate in a thin section 741. In the upper portion on each side, a cut 743 is made extending from the cut 739 to a position above the base of the conical section 735 so as to bridge that part. Thus, flow from the bottom at the base 741 flows along the smooth surfaces past the conical section 735 and in an annular path between the O-ring 735 and the stem 733.

Referring again to FIG. 4*a*, at the base of the recess 721 a spring 745 is disposed. Similarly, within a central bore 747 in the coupling member 135, another spring 745 is disposed. The spring seats against a threaded insert 717 which is screwed into the end of part 135. At the inner end of the bore 747 in part 135 an O-ring 737 is disposed. Similarly, an O-ring is contained in a recess in a member 747 screwed into the threads 723. As illustrated, the stems 733 of the two valve cores are abutting against one another, thereby separating the conical parts from the O-rings 737. In the assembled position shown, the springs 745 are essentially completely compressed. In this position, water flow from the passageway 751 which communicates with the resin bed in the carbonator tank flows past the two valves and eventually reaches the water line 99 in the manifold.

Figure 5:
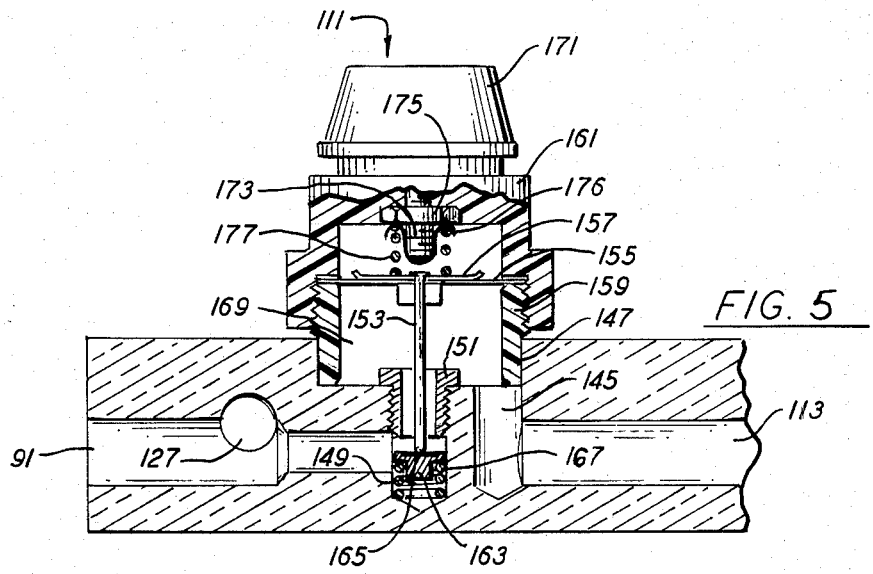
FIG. 5 is a sectional elevation view of the pressure reducing valve of FIG. 4 taken along line 5—5.

The pressure reducing valve 111 is shown in more detail in the cross section of FIG. 5 which is taken along the line 5—5 of FIG. 4. Carbon dioxide at a pressure of 40 psi reaches the channel 91 through the inlet passage 127 shown on FIG. 4. After passing through the pressure reducing valve $CO_2$ at 1 psi is fed to the channel 113 by means of an outlet passage comprising a bore 145 in the manifold. The manifold in an area above the bore 145 contains a large bore 147. Extending down from the bore 147 and in the center thereof is a smaller bore 149. This bore intersects with the passage 91 containing the 40 psi $CO_2$. The upper portion of bore 149 is threaded and contains a quide and valve seat 151. Guide 151 guides a tube 153 attached to a diaphragm 155 by means of a supporting plate 157. The diaphragm is secured in place between a body member 159 which may be integral with the manifold, or inserted into the bore 147 and a cover piece 161 which is screwed onto the body 159. The actual valving which carries out the pressure reducing takes place between the guide 151 which forms a valve seat and a valve member 163 containing in its central portion a gasket 165. The valve member 163 abuts and seals to the end of the tube 153 and is biased outward by a spring 167. The spring 167 tends to bring the valve member 163 with its gasket 165 into engagement with the seat on the guide 151. Spacing between the member 163 and the guide 151 determines the amount of gas which reaches a chamber 169 from whence it flows out the outlet bore 145. On the cover piece 161 is mounted an adjustment knob 171, having thereon a threaded rod 173 which acts on a nut 175 which is prevented from rotating by being contained in a suitable recess in the cover piece 161. Thus, rotation of the knob 171 results in linear up and down motion of the rod 173. A flange 176 secured to the rod acts upon a biasing spring 177 which is disposed between flange 176 and the disc 157 at the diaphragm 155. This arrangement with the spring 177, the tension of which is adjustable by the knob 171 and the diaphragm, coupled to the tube 153 which operates the valve member 163, results in the seating and unseating of the valve member 163 on the seat of guide 151 such as to maintain the desired pressure in chamber 169 in accordance with the biasing pressure set in with the spring 177. Ih this manner, by adjusting the knob 171 the desired pressure of 5 psi is obtained at the outlet 145.

The Dispensing Valves And Concentrate Containers

Figure 6:
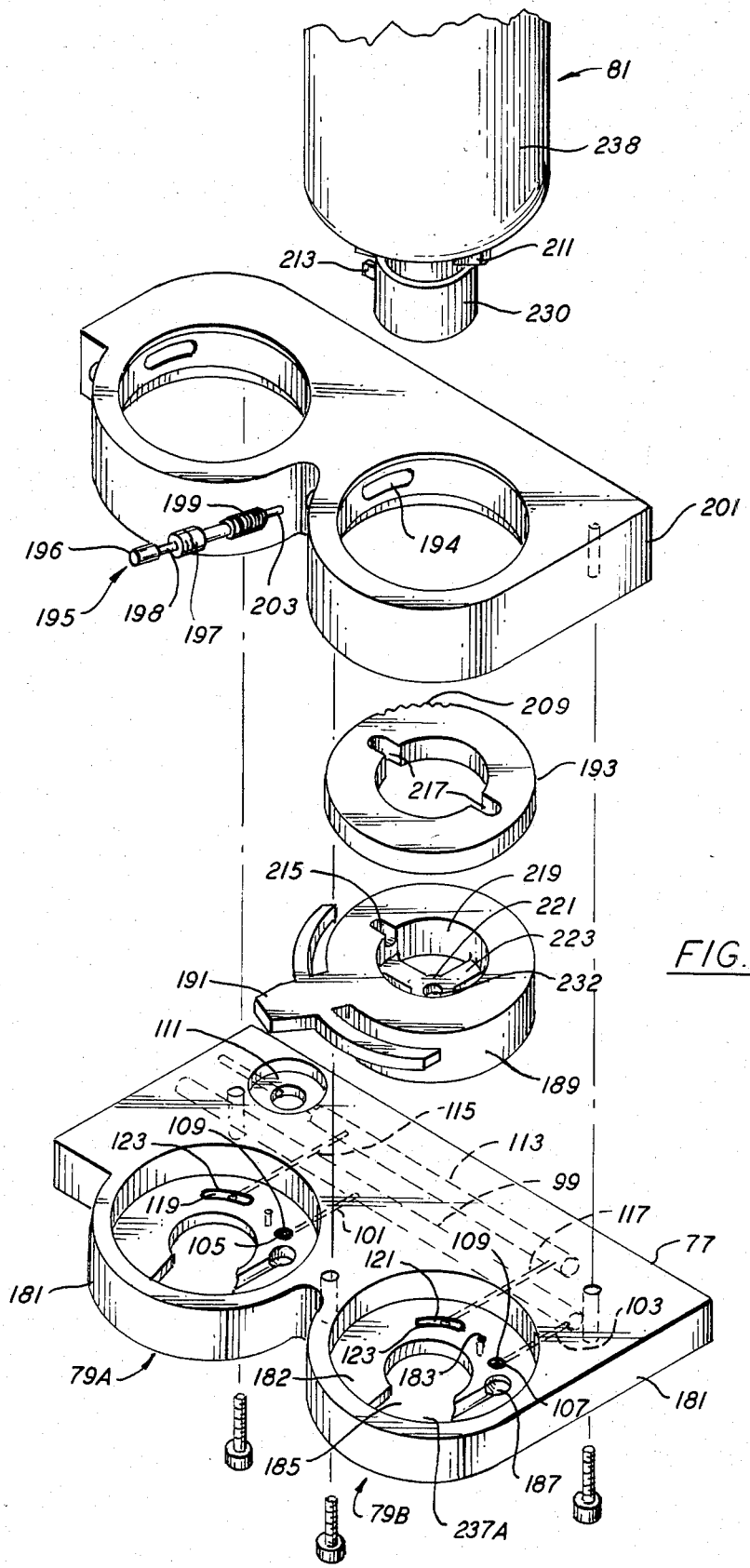
FIG. 6 is an exploded perspective view of a practical embodiment of a package or container and a rotary valve according to the present invention.

The construction of the dispensing valves 79A and 79B, shown in FIG. *2a* can best be understood first with reference to FIGS. 6, *6a*, *6b* and *6c*, in addition to FIG. 4. In the illustrated embodiment, each valve is made up of four basic parts. These include a base portion 181 which is molded as part of the manifold 77. However, it should be recognized that such base portions can be made separately with appropriate connections for a carbon dioxide pressure line 117 and a water inlet line 103.

Since both valves are identical, only the right hand valve 79B will be described in detail. The base 181 of the valve is a member containing a large cylindrical bore 182. At the bottom of this bore is located the inlet opening 121 for the carbon dioxide with its O-ring seal 123 and the inlet opening 107 for the diluent, e.g., carbonated water, with its O-ring seal 109. Also located in the base portion is a vent hole 183, an opening 185 through which the concentrate, e.g., a syrup, will be dispensed in a manner to be described below, and a drain passage 187 for the residue of diluent, e.g., carbonated water, after it has passed through the valve. Inserted into the bore 182 is a central rotating valve member 189. It is supported within the bore 182 for rotation therein in response to operation of a handle 191 and seals against O-rings 109 and 123. Overlying the central rotatable member is an adjustment disc 193. The adjustment disc remains essentially fixed but is adjustable to take into account different environmental conditions in metering of the concentrate. This adjustment is accomplished by an adjusting screw 195. As can best be seen from reference to FIGS. 4 and 6, the adjusting screw includes a knob 196 on the end of a shaft 198. The shaft passes through and is rotatable within a threaded plug 197. The threaded plug 197 is screwed into a cover portion 201 of the valve which fits over and retains in place central member 189 and adjusting disc 193. Near the end of the shaft 198 is a worm gear 199 which is secured thereto. When inserted into the cover portion 201, the end 203 of the shaft 198 is supported for rotation in a bore 207, as best seen on FIG. 4. The worm gear 199 is exposed through an opening 194 and engages appropriate threads 209 on the adjustment disc 193 permitting a limited degree of rotation thereof. Once adjusted by the adjustment screw 195, however, the disc 193 remains fixed.

As shown in FIG. 6, container 81 includes a body in the form of a necked bottle 238 and a cap 230. Dispensing of the concentrate from the container 81 is in response to a relative rotation of its cap 230 with respect to tabs 211 on the neck of bottle 238. This opens a valve in container 81 and carries out a metering action in a manner to be described more fully below. To accomplish this rotation, the cap 230 also contains a tab 213. The tab 213 engages in a notch 215 in the central member 189. The tabs 211 engage in notches 217 in the adjustment disc 193. The central valve member 189 is arranged to rotate a given amount to open the metering valve within the container by rotating cap 230 which is engaging the notch 215 in the central valve member 189. Fine adjustment of this metering is possible by means of the adjusting screw 195 which increases or decreases the initial setting of the position of the cap 230 relative to the body 238 so as to vary the rate of flow of concentrate from the container upon a preset and subsequent rotation of cap 230.

Figure 7:
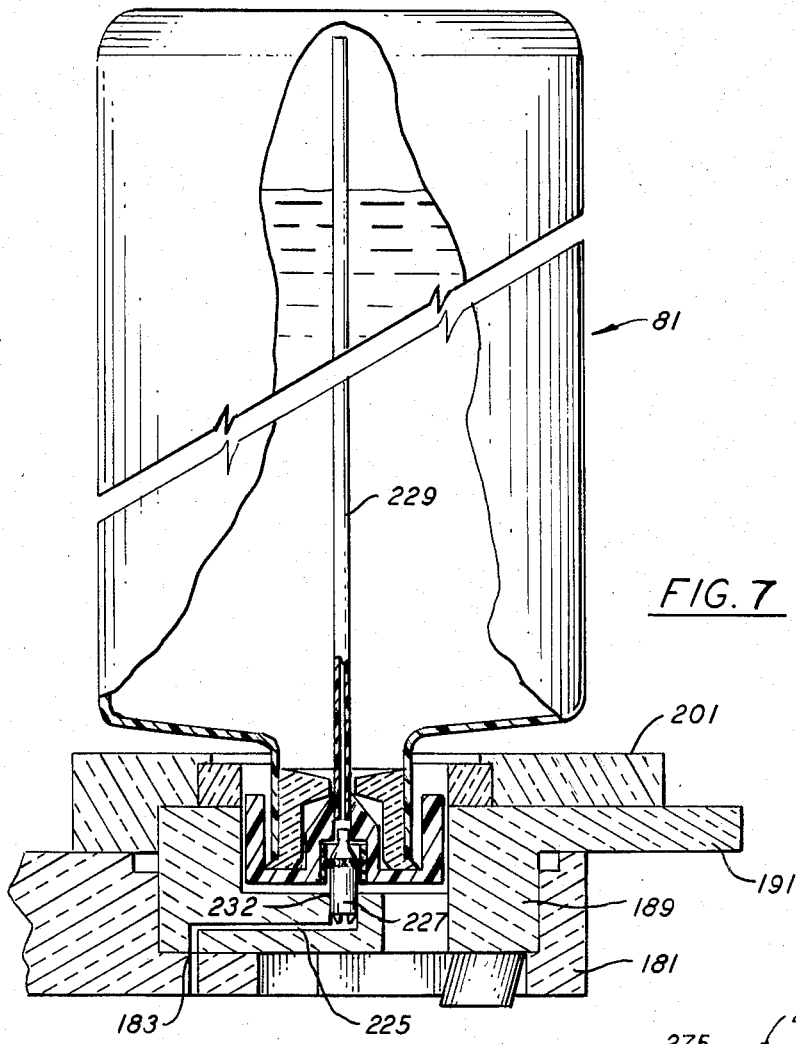
FIG. 7 is a section along the lines 7–7 of FIG. 4.

The dispensing valve performs three separate functions. It performs a function of venting the container, a function of pressurizing the container with the low pressure carbon dioxide and a function of causing the simultaneous dispensing of concentrate and diluent. The central valve member 189 contains a central bore 219 at the bottom of which there is provided a cylindrical member 221, containing a partial bore 232 in the upper portion thereof, and supported by three struts 223. One of the struts 223 contains therein a passage 225 which communicates with the bore 232. The other end of the passage 225 is brought through to the bottom of the central valve member 189 and at a location permitting alignment with vent hole 183 and outlet 121 in the base member 181 of the valve. As best seen from FIGS. 7 and 8 inserted within the bore 232 is tubular member 227. This tubular member communicates with a tube 229 extending to the bottom of the container 81 (which will be the top with the container 81 in the inverted position shown) for the purposes of venting and pressurizing, in a manner to be more fully described below.

With reference to FIG. *6a*, the position of the valve with the handle 191 fully to the left is shown. In this position, containers are inserted into and removed from the equipment and the passage 225 is aligned with the vent hole 183 permitting venting of the container 81 through tube 29, tubular member 227, passage 225 and vent hole 183. This corresponds to the cross sectional view of FIG. 7.

Figure 6A:
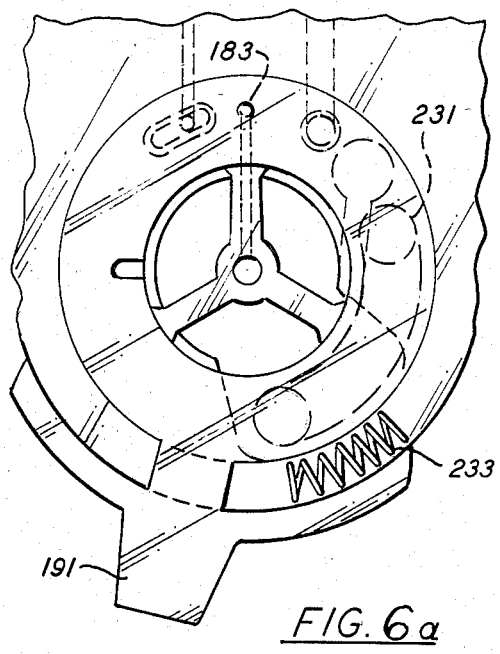
FIGS. 6*a*, 6*b* and 6*c* are diagrammatic presentations illustrating the three possible positions of the valve of FIG. 6.
Figure 6B:
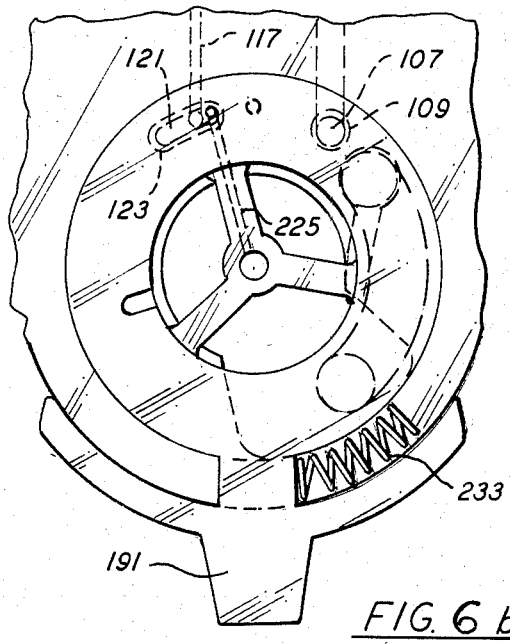

In the position shown in FIG. 6*b*, which is a quiescent position of a container in the machine, the interior of the container is pressurized, but there is no flow of concentrate or diluent from the machine, and the container cannot be removed from the machine, handle 191 is centered, the passage 225 is overlying the opening 121 and is sealed by the O-ring seal 123. This admits the low pressure carbon dioxide to the passage 225 from whence it can flow through the tubular member 227 into the container through tube 229, to pressurize the container with a constant pressure. In this position, the diluent outlet 107 with its seal 109, is still covered by the bottom of central valve member 189. This corresponds to the cross section of FIG. 8.

Figure 6C:
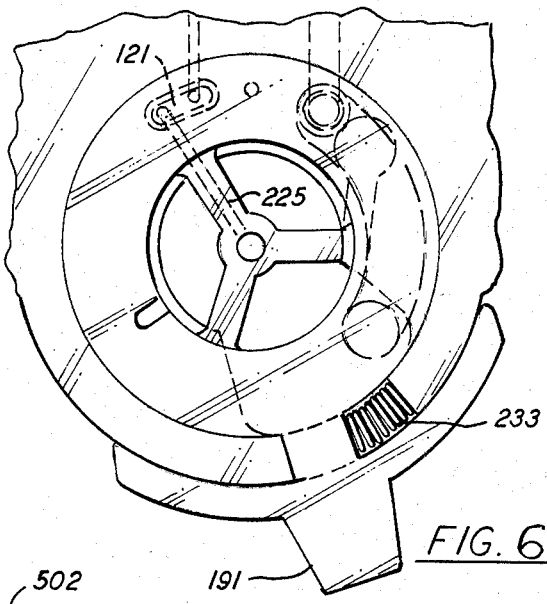

Finally, in the position shown in FIG. 6*c*, which is the dispensing position in which concentrate and diluent flow from the machine, and the container cannot be removed, the handle 191 is all the way to the right, and an inlet opening 231 in central valve member 189 is aligned with the opening 107 to permit a flow of diluent, e.g., carbonated water, through and out of the valve. At this time, because of the elongated opening 121, the passage 225 is still in communication with the carbon dioxide supply to maintain pressurization of the container. This corresponds to the cross section of FIGS. 9 and 10. Movement of the handle 191 to the right takes place against the biasing force of a spring 233 which is arranged to return the handle 191 to its middle position.

Once pressurized, if it is desired to remove the container with the concentrate and replace it with another, it is only necessary to move the handle 191 to the position shown in FIG. 6*a*, to vent the container 81 to permit relieving the pressure therein and allow removal.

Figure 9:
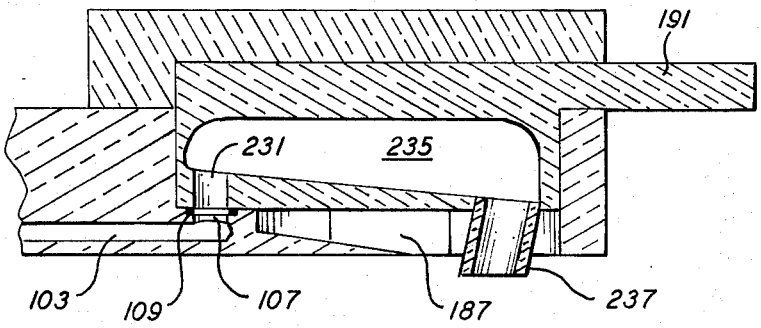
FIG. 9 is a section along the lines 9—9 of FIG. 4 illustrating the diluent flow channels.
Figure 10:
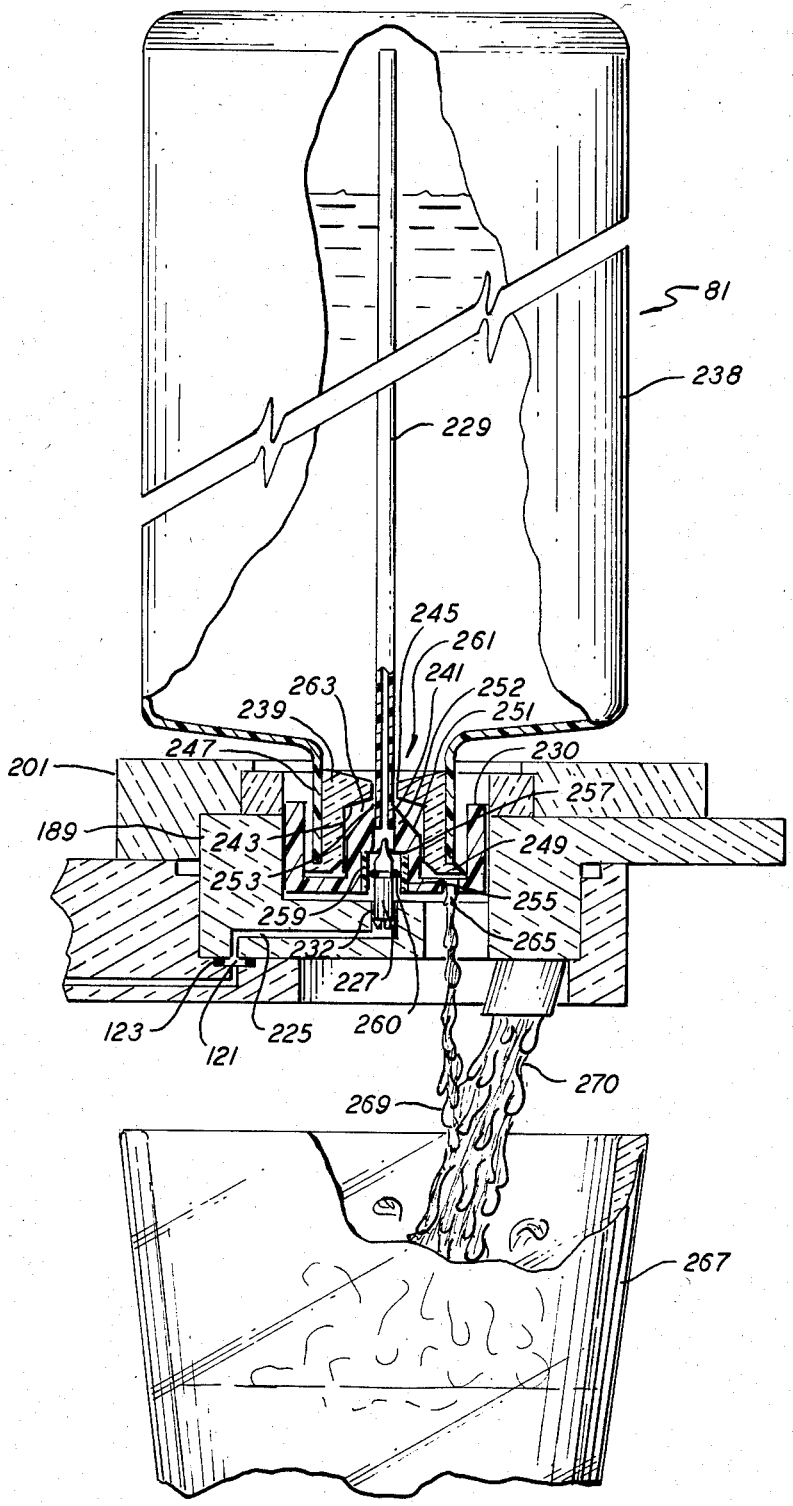
FIG. 10 is a section along the lines 10—10 of FIG. 4 showing the valve of FIGS. 4 and 6 in the dispensing condition.

The cross section of FIG. 10 shows the passage 225 still aligned with the opening 121 during dispensing. The passages for the carbonated water in this position, i.e., the position also shown in FIG. 6*c* is illustrated by FIG. 9. Shown is the passage 103 which communicates with the opening 107 which is surrounded by the O-ring seal 109, sealing against the rotar valve member 189 and communicating with the passage 231 therein. The diluent thus flows into a pressure reducing chamber 235, and thence out of a spout 237, which is carried by member 189. It will be appreciated that spout 237 therefore moves with member 189 and because it projects under the base 181, the base is provided with a lobe cutout 237A (FIG. 6), to permit the spout to so move. The spout is directed at an angle to cause mixing of the diluent and concentrate in a manner to be seen more clearly below in connection with FIG. 10. Chamber 235 is designed for minimum agitation of the diluent to prevent excessive loss of carbon dioxide. The dimensions of chamber 235 and spout 237 are such that an adequate flow of diluent is maintained, and that, with a predetermined diluent pressure, the outlet flow rate is sufficient to obtain the necessary mixing with the concentrate without excessive foaming. When the handle 191 returns to the position shown in FIG. 6*b*, the passage 231 overlies the drain passage 187 which has a downward slope. Thus, any diluent remaining in chamber 235 can drain into a glass or cup placed below.

Figure 8:
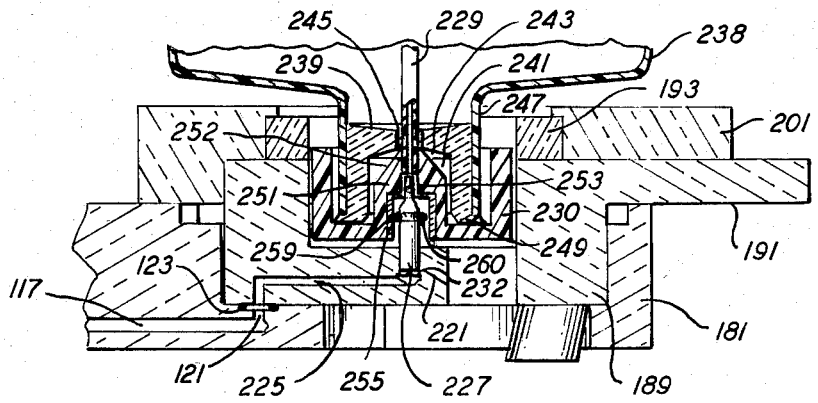
FIG. 8 is a section along the lines 8—8 of FIG. 4.

Referring now to FIGS. 8 and 10, it will be seen that the bottle 238 has a plug 239 in its neck. The plug contains a central bore 241 having a sloped portion, i.e., of somewhat conical shape, 243 at its inner end. There is a central passage 245 through the inner end of the plug. The plug is Of generally cylindrical shape and is press fitted into the neck 247 of the bottle 238. Alternatively it can be molded as part of the bottle 238. At its outer end, the plug contains a circumferential flange 249 which extends beyond the neck 247 of the bottle. Placed over the neck of the bottle is the cap 230. The cap contains, in its central portion, a cylindrically shaped member 251 which terminates in a conical section 252 at its inner end. Conical section 252 abuts against the tapered conical section 243 of the plug 239. Inwardly extending member 251 contains at the inner end thereof, a bore 253 into which is inserted the dip tube 229. The dip tube extends through the opening 245 in the plug with a spacing. At the outer end of the cap, in the center thereof, is a larger bore 255 extending into member 251 and communicating with bore 253. At the inner end of this bore a check valve 257 is disposed. In the case of the present embodiment, the check valve is in the form of a split seal valve. However, any other type of check valve can be used. The split seal check valve is held in place by a cylindrical insert 259. The fitting 227 which is surrounded by an O-ring seal 260 to seal inside the cylindrical insert 259 in cap 230, is inserted into the center of the insert 259 and acts against the check valve 257 to open it permitting carbon dioxide to flow into the container through the dip tube 229. In the portion of the container above the plug 239, the concentrate will be contained. The cooperation between the plug 239 and the inward projecting member 251 on the cap perform the valving action needed to dispense a metered amount of concentrate. The conical surface 243 of plug 239 forms a valve seat for the conical tip 252 of member 251. It can be seen, that movement of the member 251 away from the plug 239 will permit a flow of concentrate around the dip tube 229 and into the area between the member 251 and the plug 239

What happens when such movement occurs is illustrated by FIG. 10. As shown by the arrows 261, concentrate flows around the dip tube 229 and into a space 263 between the plug 239 and the member 251. At the same time, the flange 249 has been lifted away from the cap 230 and an opening 265 formed in the cap is exposed. In the closed condition, a double seal is provided. First there is the seal between conical surfaces 252 and 243, second is the seal between flange 249 over opening 265. With the cap 230 moved downward, concentrate can now flow through opening 265 under the pressure which is maintained in the container because of the $CO_2$ and drop, through a gap between the struts 223 shown FIG. 4, and FIG. 6*c*, into a cup 267, placed below the dispensing valve. The flowing concentrate 269 flows essentially straight down. The diluent, e.g., the carbonated water, flows from the spout 237 at an angle intersecting the flow of concentrate in free space and mixing with it prior to reaching the cup 267.

Figure 11A:
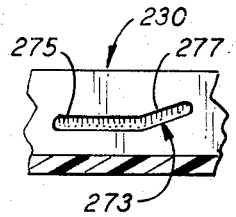
FIG. 11*a* is an unfolded view of the camming slot of FIG. 11.
Figure 11:
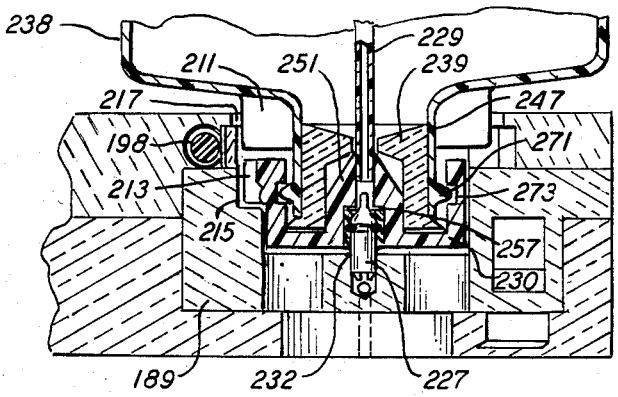
FIG. 11 is a section along the lines 11—11 of FIG. 4 illustrating the camming action within the container.

As noted above, the valve within container 81 is opened in response to rotation of its cap 230 with respect to its body 238 brought about by rotation of central valve member 189 with respect to adjustment disc 193 which, once adjusted by adjusting screw 195, remains fixed during operation. The manner in which the rotary motion of the central valve member 189 brings about a separation of the plug 239 and the member 251 in the cap 230 is best illustrated by FIGS. 11 and 11*a*. In FIG. 11 the insertion of the tabs 211 into the slots 217 in the adjustment ring 193 is illustrated. As described above, this holds bottle 238 fixed. Furthermore, the manner in which the tab 213 on the cap 230 is inserted into the slot 215 to cause the cap 230 to rotate with central valve member 189 is also evident. The relationshown in FIG. 6*c* against the force of the return spring 233. In this position, the channel 225 is still lined up with the opening 121 and the container remains pressurized. The water outlet 231 lines up with the opening 107 and carbonated water is dispensed from the spout 237 shown on FIGS. 9 and 10. The nibs 271 have now moved into the slanted section 277 of the slot 273 in the cap 230. This results in the cap being moved downward so that the member 251 moves away from the plug 239, opening the metering valve for the concentrate which now flows in the direction of the arrows 261 shown on FIG. 10 into the space 263 and thence out the hole 265 in the cap and down toward a cup 267 in a stream 269. The downward flowing stream 269 intersects the stream 270 of carbonated water in free space causing the two to intimately mix as they are dispensed into the cup 267. When the desired amount of drink has been dispensed, the handle 191 is released and returns to the position shown on FIG. 6*b*. The bottle 238 remains pressurized, but the flow of concentrate is stopped because of the closing of the valve therein and the flow of carbonated water stopped because of the movement of the outlet 231 away from the opening 107. Any water left in chamber 235 or inlet 231 of FIG. 9 can drain both through spout 237 and drain outlet 187 to completely drain all diluent. From this point on, additional drinks can be dispensed simply by moving the handle 191 to the position shown in FIG. 6*c*.

Assume for the moment that the two concentrate containers 81 contain respectively cola and diet cola. Assume it is now desired to dispense quinine water. One of the containers 81 must thus be removed and replaced with another containing a quinine water concentrate. The container 81 to be removed is, of course, pressurized. To relieve the pressure in the container 81, the handle 191 is moved to the position shown in FIG. 6*a*. In this position, the container is now vented, venting taking place through the passage 225 and the vent opening 183. With the pressure relieved on the concentrate container 81 it may now be removed. As it is removed, referring to FIG. 8, it is evident that once it is lifted upward and the fitting 227 is no longer acting against the check valve 257, the check valve 257 will close. This prevents any possibility of the concentrate getting into and dripping out of the dip tube 229. The new container is then put into place after which the steps described above are followed.

Typically, the cola concentrate will be a relatively thick syrup whereas the quinine water concentrate will be relatively thin. This requires different degrees of opening of the valve made up by the member 251 and plug 239. The necessary metering which must be carried out is accomplished by adjusting the positioning of the tab 213 with respect to slot 273 on cap 230 during manufacture. In other words, in the rest position, referring to FIG. 11*a*, for a cola syrup the nib 271 will be close to the angled section 277, but not so close as to cause flow of concentrate from the container when the rotary valve is in the FIG. 6*b* position. On the other hand, for something like quinine water it will be placed further to the left so that, with movement of the valve to the FIG. 6*c* position, the nibs 271 will only ride up on the angled portion a small amount. Alternatively, this control can be obtained by using different angles on the angled portion 277.

Figure 18:
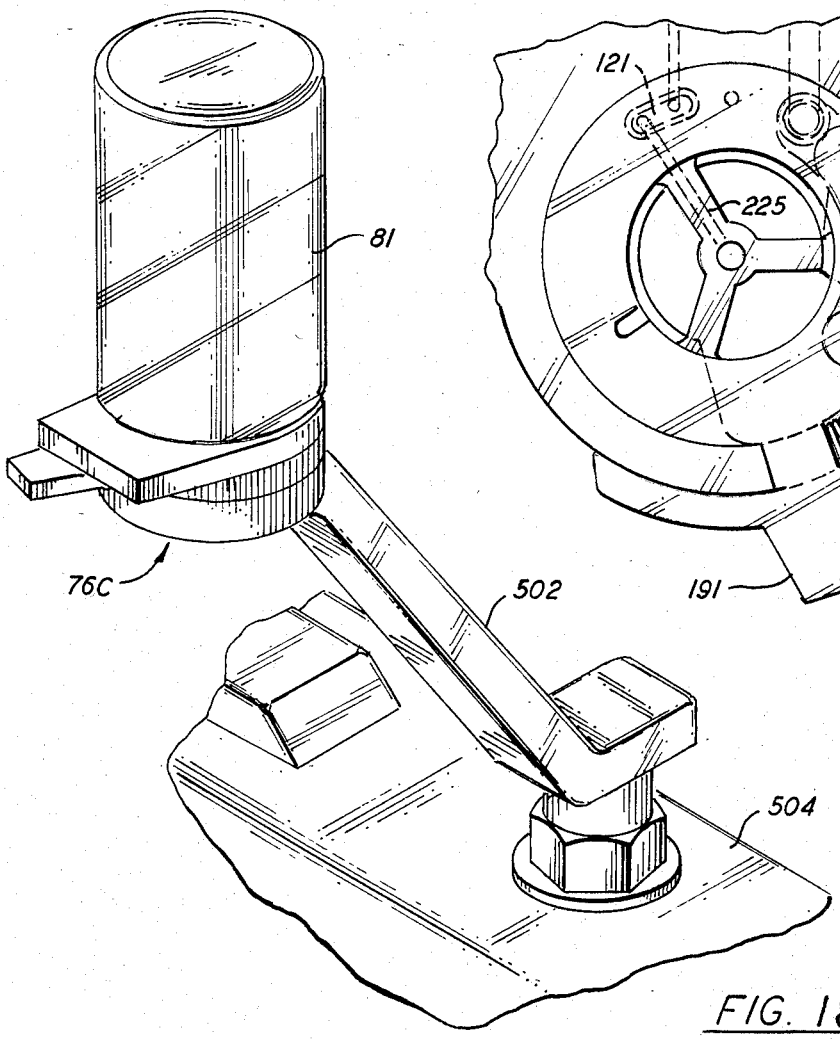
FIG. 18 is a perspective view of an embodiment of the valve adapted as a sink dispenser.

An alternate embodiment for the dispensing valve is illustrated in FIG. 18. In some cases it may be desired to have the dispensing unit at a sink. In such a case, the remainder of the above described apparatus would be disposed below the sink. In such a case, the valve would, of course, not be part of the manifold 77. Rather, referring, for example, to FIG. 4, the lines 113 and 99 will be brought out from the manifold through suitable fittings 104 and 118 similar to fittings 129 and 131, described above, containing check valves. A quick disconnect coupling such as the coupling 89 may mate to these fittings with tubing extending from the coupling to inlets at the rotary valve 76C. Valve 76C is disposed on the end of an angled arm 502 with a container 81 placed thereon. The arm is supported for rotation over a sink 504. For example, the opening in the sink normally used for a spray attaohment can be used. When not in use, the arm 502 may be rotated counterclockwise to move the dispenser out of the way into a locked position. When it is desired to dispense, the arm 502 is moved to the position shown and dispensing can be carried out over the sink so that any spillage or drippings will be caught in the sink. Preferably, the arm 502 and at least the visible parts of the valve 76C in this case will be made of a material to match the sink fittings.. Operation of the valve 76C in conjunction with the container 81 in all other respects will be the same as described above. In this embodiment, and in the previously described embodiments, the rate of flow of the diluent can be controlled either by disensioning of the size of the diluent tubing or passages, e.g., passage 103, or by the insertion of a limiting orifice, for example, at the inner end of the stub 131.

The various advantages both with respect to construction and operation of the dispensing arrangement including the valve and container should be evident. It can be made essentially of all plastic parts which are easily molded. Other materials can, of course, be used. For example, the bottle 238 may be made of glass or metal. By forming the dispensing valve in one piece with the manifold and through the design of a manifold which essentially carries the supply of materials to the valve, the need for numerous tubes and the disadvantages associated therewith are avoided. The design of the valving in the container permits presetting at the factory, with the adjustment screw on the manifold giving the fine adjustment necessary to take care of temperature variations or personal taste. Furthermore, it is important to note, when referring to FIG. 10, that the concentrate passes directly from the container into the cup. It has been well established, that mold growth is likely to occur with dilute syrup. With the disclosed dispensing arrangement the syrup is diluted only after leaving the dispenser. This offers great advantage over most prior art dispensers in which mixing took place within the machine and which could lead to unsanitary conditions.

The Carbonator and Cooling Systems

Figure 12:
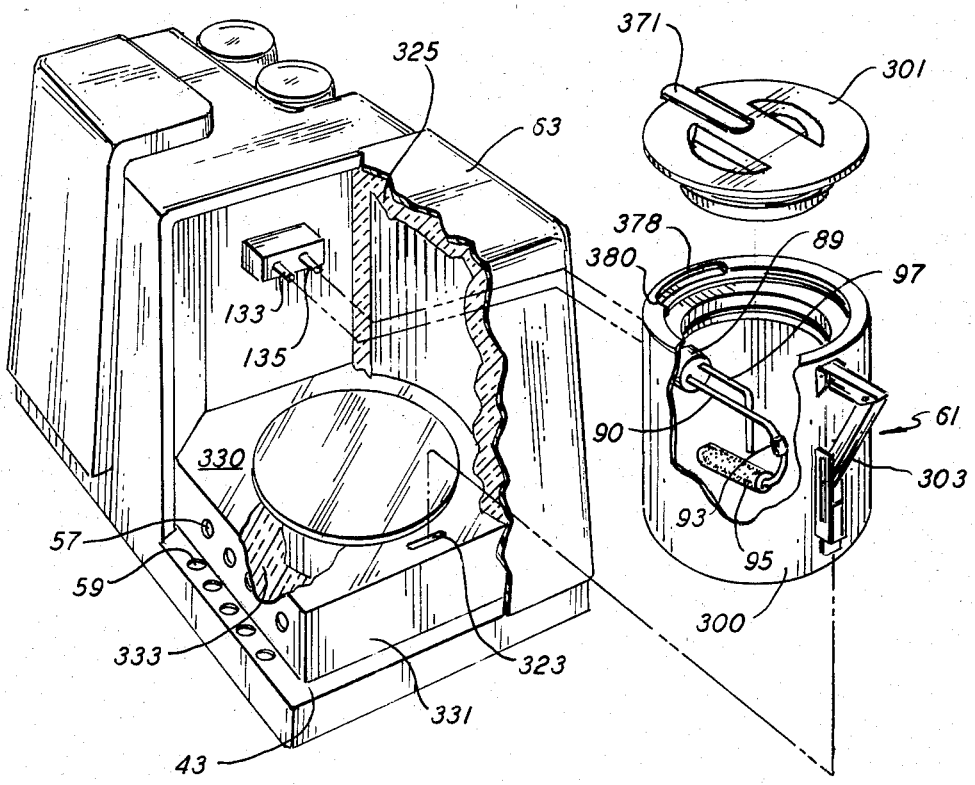
FIG. 12 is an exploded perspective view of the dispenser showing the carbonator section.

The remainder of the system is also designed with a view toward ease of operation and low cost. The fact that a quick disconnect coupling 71 is provided for the carbon dioxide bottle 68 has already been noted. In addition the quick disconnect nature of the carbonator has also been noted. The carbonator will now be explained in more detail in connection with FIG. 12 which is an exploded perspective view of the dispenser showing the manner of insertion and removal of the carbonator. In the disclosed embodiment of the drink dispenser of the present invention, the unit is free-standing, i.e., it is not connected to the plumbing. It will be recognized that with respect to what has been previously disclosed, i.e., with respect to the dispensing arrangement and the manifold, such can be equally well used in a plumbed-in or an automatically recharging unit if provided with the necessary oontrols, e.g., temperature, level, etc. In the unit of FIG. 12, the carbonator 61 comprises a metal tank 300 preferably of stainless steel or aluminum, having a lid 301 which is removable in order to refill the carbonator 61 with water. As previously explained, the carbonator 61 includes a quick disconnect coupling 89 from which one line 90 leads through a restriction or orifice 93 to a dispersion block 95. Carbonated water is forced out of the unit through a line 97. Also shown in FIG. 12 is the end of the manifold 73 with the two connecting fittings 133 and 135 projecting therefrom. As explained in detail in connection with FIG. 4, these insert into appropriate bores in the fitting 89. As also explained in connection with FIG. 4, there are valves both in the fitting 89 and the connecting stubs 133 and 135 of the manifold. Hence, when the tank 61 is pulled away and disconnected from the manifold, the pressure within the dispensing unit, i.e., that pressurizing the containers 81 and the carbonated water in the various passages, which is under pressure, and the gas under pressure being fed from the $CO_2$ tank are not released. Without such valving, carbonated water would be released from the connecting fitting 135 and the 40 psi carbon dioxide would flow from the fitting 133.

At the same time, the valves within the coupling 89 prevent the carbonated water under pressure from being discharged from carbonator 61 and also prevent any discharge through the carbon dioxide inlet. In order to aid in the quick disconnect of the carbonator tank 61 and also aid in handling it when disconnected, i.e., to permit refilling, a folding handle 303 is provided. A view of the handle 303 is also provided in the cross section of the carbonator shown on FIG. 13. The handle includes a bracket 305 which is attached vertically to the carbonator tank 300. This is essentially a U-shaped bracket which contains a cutout portion 307 in its central portion, i.e., at this portion only the base of the U is present. The handle itself comprises two arm sections, an upper arm section 309 and a lower arm section 311. The two arm sections are hinged together by means of a pin or rivet 313. The upper arm section 309 is also hinged to the upper part of the bracket 305 by means of a pin or rivet 315. The other end of the lower arm 311 contains a pin or rivet 317 which passes through a slot 320 formed in the U-shaped bracket 305 near its bottom and is retained in place by washers 319. Also hinged to the pin 317 is a downwardly extending retaining pin 321. In the position shown in solid lines on FIG. 13, with the handle folded against the tank 300, the pin 321 extends through an appropriate hole 323 in a support plate 330 in the top of the cooling unit 55. This, along with the insertion of the connecting stubs 133 and 135, into the fitting 89, retains the tank 61 in the correct place against the tension of the springs in the check values. Alternatively, coupling 89 could be on the bottom or vertically disposed on the side of carbonator 61 and the weight of carbonator 61 used to help to maintain the connection.

When it is desired to remove the tank, after removal of cover 63, the handle 303 is moved to the position shown in dotted lines. The pin 317 slides upward in the slot 320 at the same time carrying with it the retaining pin 321. It is now possible to remove the carbonator to refill it with water.

Figure 13:
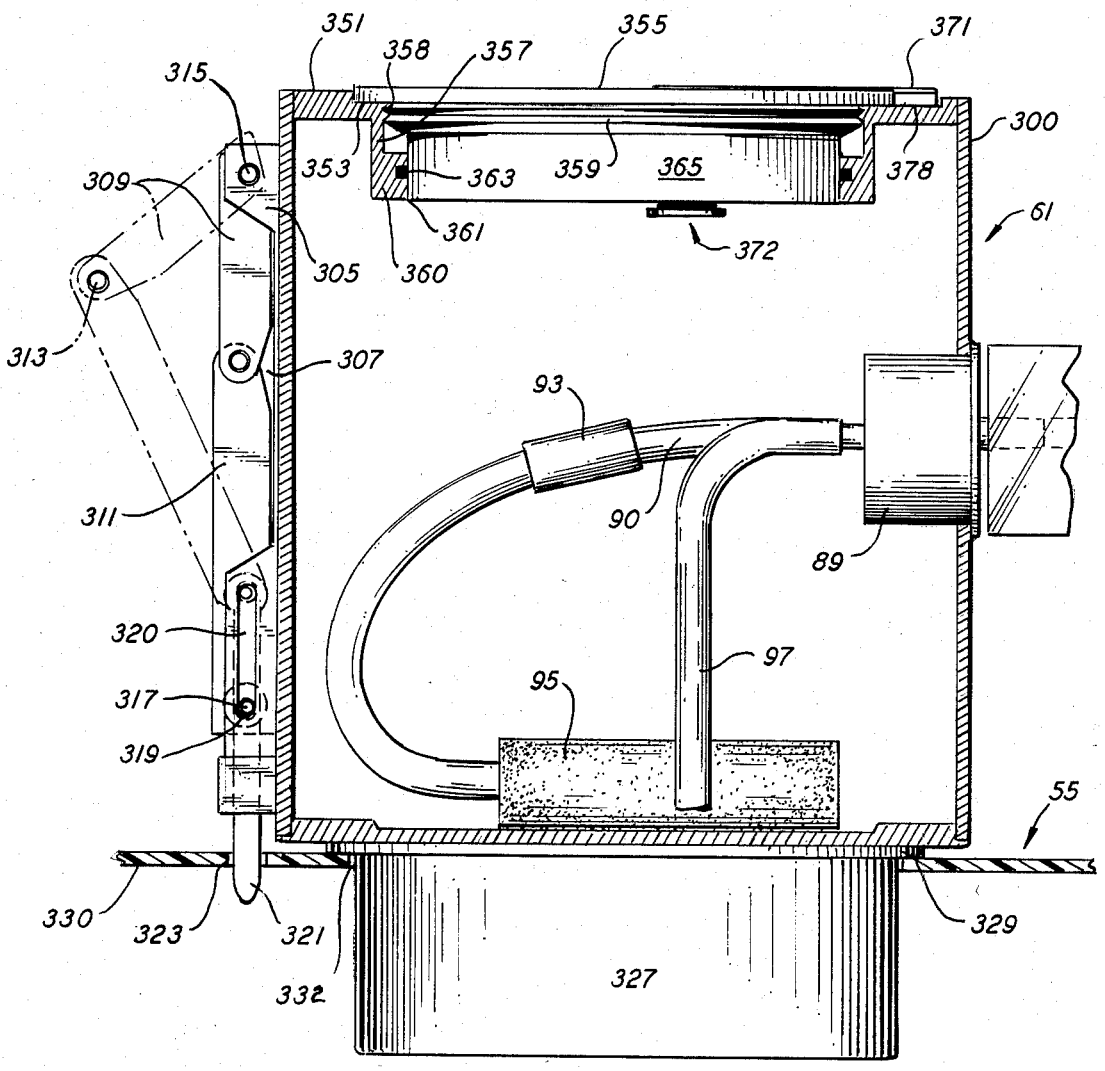
FIG. 13 is a sectional elevation view of the carbonator of FIG. 12.

Since the carbonator after being removed for refilling will still be under a pressure of 40 psi it is essential that the pressure be released before the cover is removed. Otherwise, the cover could blow off possibly causing serious injury to the user. Furthermore, it is important that a good seal be maintained between the cover 301 and the container 300. The present invention provides a novel design of the mating of the cover with the container which both insures that the cover cannot be removed until the pressure is released, and at the same time insures that the cover will always be adequately sealed, after the carbonator is refilled. The manner in which the cover fits into the container 300 is best illustrated by FIGS. 12 and 13.

The container 300 at its top 351 (the container is of solid welded construction) has a stepped profile. It has an upper recess 353 of first internal diameter in which a top flanged section 355 of the cover 301 rests. Following this is a portion 357 of somewhat smaller internal diameter containing internal threads 358. The cover 301 contains matching external threads 359 which screw into the threads 358 but which extend to a greater depth on the lid than on the portion 357. This section is followed by a section 360 of still smaller internal diameter which contains on its vertical surface 361 an O-ring seal 363. O-ring seal 363 seals against a cylindrical circumferential portion 365 of the cover. Because of the location of the seal 363, a radial rather than the conventional axial type seal takes place. What this means is that the carbonator will be sealed even if the cover is not screwed on completely tightly, in contrast, with an axial seal, where good sealing depends on the cover being screwed on tightly. This essentially eases operation for the user, typically a housewife, and does not require critical alignment or the application of a certain amount of pressure in order to get good sealing.

Figure 16:
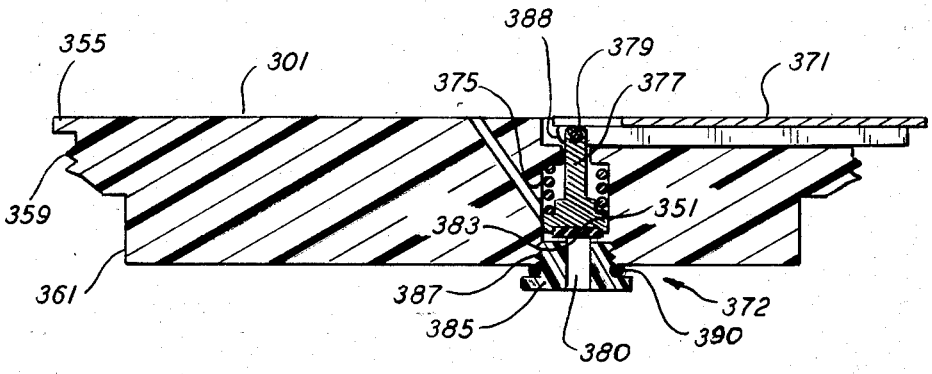
FIG. 16 is a sectional elevation view of the carbonator lid of FIG. 12.

In order to ensure that pressure is released before the cover is removed, a rotatable handle 371, shown on FIGS. 12 and 16, is provided. This handle rotates to operate a relief valve 372 the lower portion 373 of which is visible in FIG. 13.

As shown in FIG. 16, handle 371 is hinged to a plunger 377 by means of a pin 379. Plunger 377 has, in a recess 351 at its end, a rubber sealing disc 383. This seals against a plastic valve seat member 385 containing a central bore 380 which is screwed into threaded bore 387 in the lid 301 and sealed against the bottom of lid 301 with an O-ring seal 390. A spring 375 biases the plunger 377 against seat member 385. Rotation of handle 371 upward lifts plunger 377 off seat member 385, by means of a larger radius 388 at the handle end, to release the pressure in the carbonator 61 through a vent bore connecting the biasing spring chamber to atmosphere. This valve also acts as a safety valve in that if the pressure exceeds an amount determined by biasing spring 375, the plunger 377 will lift off seat member 385 the pressure being released through the vent bore as discussed above.

Thus, rotation of the handle 371 upward when it is desired to refill the container, automatically opens the valve to release the pressure. Unscrewing of the cover 301 without operating the handle 371 is prevented by having the handle 371 extend beyond the circumference of the uppermost portion 355 of the cover. A cutout 378 is formed in the top 351 of the container 300 as best seen in FIG. 12. When cover 301 is screwed into place, the handle 371 snaps into this cutout 378. When one attempts to unscrew the cover without lifting the handle 371 it will come into contact with the edge 380 of cutout 378 preventing further turning until the handle is lifted and the pressure released. Furthermore, because of the pressure, turning will be very difficult, by hand, without first releasing the pressure. This too is a reminder to operate handle 371. Finally, should handle 371 be broken off, or the vent valve fail to operate and someone uses a wrench or the like to generate enough torque to turn the cover when the vessel 61 is under pressure, leakage past the threads, which will still be engaged when the seal at O-ring 363 is broken, will bleed the pressure off before the cover 301 is free of tank 300.

FIGS. 17*a–d* illustrate an alternate embodiment of a closure for the carbonator lid. Shown is a carbonator lid 301*a* with a cylindrical opening 501 therein. Inserted within the opening 501 is an insert 503 having a first cylindrical section 505 press fitted into the opening 501 followed by an outwardly flared section 507 and a terminating cylindrical section 509.

The closure, or stopper mechanism, which is utilized to close the opening in the cover 301*a* is of a nature similar to devices used as stoppers for vacuum bottles and also as boat plugs. However, as with the previously described cover for the carbonator, it is necessary that such a closure incorporate means to insure that pressure is relieved before the cover or stopper is removed, and it is also desirable that the closure be capable of performing as a pressure relief valve. The arrangement illustrated on FIGS. 17*a–d* accomplishes all of these functions. The member which actually closes the opening comprises a compressible stopper of rubber, for example. The stopper, which is of cylindrical shape with a central bore 512, in the uncompressed state (See FIG. 17*d*), is fitted over a tube 513. At its inner end tube 513 is threaded. At the inner end of the stopper is a washer 515 which is held in place by a nut 517 screwed on to the threaded end of tube 513. The stopper 511 is compressed between washer 515 and a washer 519 at the outer end of the stopper, also slid over the tube 513. The tube 513 contains a bore 521 in its outer end which terminates in a conical valve seat 523. A smaller bore 525 extends from the valve seat through to the inner end of the tube 513. At the end of the tube projecting through the washer 519, the tube is slotted to provide two diametrically opposed members or ears 527 and 529. Each of the ears 527 and 529 contains a hole 531 through the center thereof. A bolt 533 on the end of which is a nut 535 passes through these holes and through corresponding holes 537 in camming means 539. Camming means 539 comprise a member of essential U-shaped cross-section with two identical cam surfaces 541 on the legs thereof on the end of which is a U-shaped lever arm 543. The cam surfaces 541 act against the washer 519. In the position shown in FIG. 17*a*, the distance between the bolt 533 and the circumference of the cam surface 541 is a maximum. This in turn causes the bolt and with it the tube 513 to move outward compressing the compressible stopper 511. In the position shown in FIG. 17*c*, the radius of the cam surface 541 remains essentially the same, still maintaining compression. Finally, in FIG. 17*d*, the distance between the bolt 533 and the flattened portion 541*a* of the cam surface is now reduced to permit the compressible stopper to take the cylindrical form shown in FIG. 17*d* and allow its removal.

What has this far been described is a conventional compressible stopper arrangement typically used in vacuum bottles and as a boat plug. The primary difference is that the conventional device does not have a hollow rod such as the tube 513 but a solid rod.

In accordance with the present invention, seated against the valve seat 523 is a valve member 545 on the end of a rod 547. The rod extends, with a spacing, through a threaded plug 549, which is screwed into internal threads in the end of the tube 513 and provides a guide for rod 547. Biasing spring 551 is disposed between the guide 549 and the valve member 545 biasing the valve member against the seat 523. The end of the rod 547 is attached to an oval ring 553. Between the two ears 527 and 529, a cam 555 is mounted to bolt 533. Bolt 533, at least in the central part thereof, has a square cross-section so that the cam 555 turns with the bolt and the camming means 539. Ears 527 and 529 are, of course, mounted so that the bolt 533 turns within them e.g., the bolts is round where it passes through ears 527 and 529.

Figures 17A, 17B, 17C, 17D:
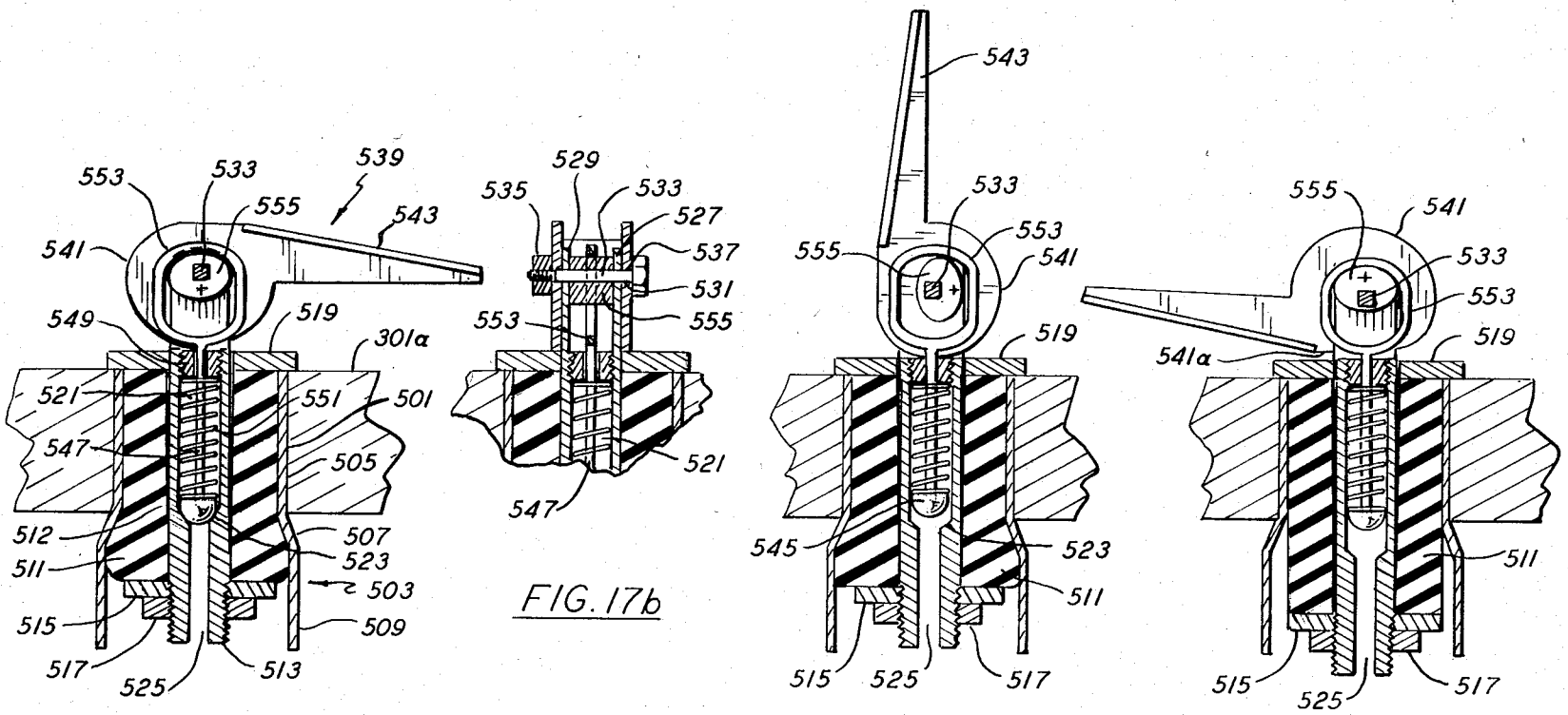
FIGS. 17*a–d* are views of an alternate embodiment of a closure for the carbonator lid.

In the position shown in FIG. 17*a*, there is a slight spacing between the oval ring 553 and the cam 555. This allows the biasing spring 551 to bias the valve member 545 against the seat 523 to prevent the passage of fluid. The spring force is selected to provide a biasing pressure which will counteract the design pressure within the vessel with which the closure is used. For example, when used in the carbonator of the present invention the spring would be set for a pressure slightly greater than 40 psi. If excessive pressure builds up within the carbonator tank the valve acts as a pressure relief valve. The biasing force of spring 551 is overcome and the pressure within the tank will lift the valve member 545 off the seat allowing excess pressure to be relieved. The fluid, e.g., carbon dioxide, under pressure would flow through the bore 525 past the valve member 545 through the bore 521 escaping between the rod 547 and the opening in the guide member 549. In order to permit pressure relief, the rod is disposed within the guide member 549 with a small spacing. The nature of cam 555 is such that in the position shown in FIG. 17*a*, the distance between the axis of the bolt 533 and the cam surface is a minimum. As noted above, in this position there is a slight spacing between the cam surface and the ring 553. At the position shown in FIG. 17*c* in which the handle 543 has been rotated through 90°, a second, larger distance, results. Because of this, the cam surface comes into contact with ring 553 raising the ring and with it, the rod 547. This lifts the valve member 545 from the seat 523 and allows a pressure reduction through the valve which will take place at a controlled rate based on the valve orifice and the cross-sectional area between the rod 547 and the hole in the guide member 549. As noted above, in this position, the cam surface of cam 541 is still maintaining the compressible stopper in the compressed state. Finally, as shown in FIG. 17*d*, further rotation of the handle 543 releases the stopper while at the same time maintaining the valve member 545 raised from the seat 523. This results because the cam surface of cam 555 is such that between the position shown in FIG. 17*c* and 17*d* it maintains the ring at the same distance from the axis of the bolt 533 holding the valve open.

Carbonator Cooling System

As illustrated in FIG. 12, since the carbonator is cooled, the cover 63 will contain, on its inside, a layer of insulation 325. Cooling is accomplished one of two ways. In the embodiment shown on FIGS. 12 and 13, cooling is done utilizing a pan 327 of essentially cylindrical shape and having a lip 329 at its top. The pan is filled with what is commonly known as "Blue Ice", a type of material typically used for cooling in picnic coolers. The pan containing the Blue Ice sealed therein is placed in a home freezer and frozen prior to use. It is then inserted into the dispenser. For this purpose, a support plate 330 having a circular opening 332 therein to receive the pan 327 is provided. The plate 330 is supported in conventional fashion on a rectangular frame 331 which forms part of the cooling unit. In addition, the inside of the rectangular frame 331, this frame resting on the base 43 of the dispensing unit, contains insulation 333 to prevent rapid melting of the Blue Ice.

Shown on FIG. 12 are ventilation holes 57 in the rectangular frame 331, and ventilation holes 59 in the base 43. These are not required with this type of cooling unit but ar used with the cooling unit to be described in connection with FIG. 14 below The plate 330 in which the pan 327 is inserted is preferably of a material with poor heat conductivity, such as polypropylene.

Figure 14:
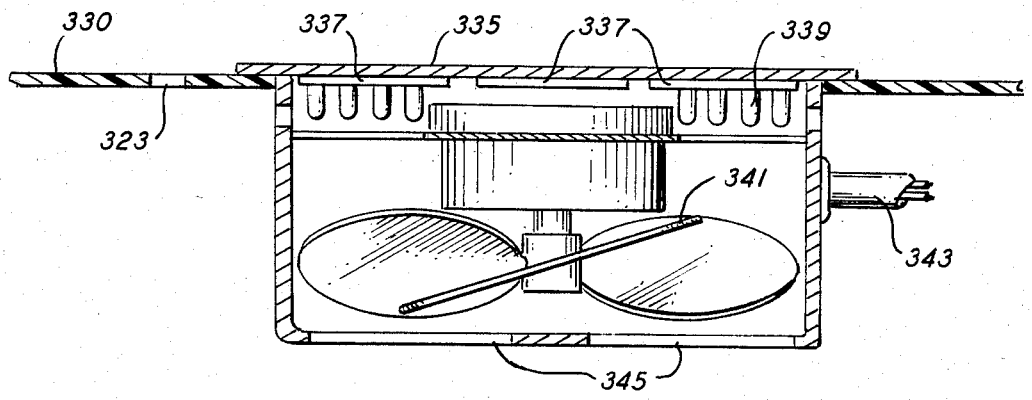
FIG. 14 is a sectional elevation view of a thermoelectric cooling arrangement for the carbonator.

In the alternate embodiment shown in FIG. 14, the dispenser is provided with an electrical cooling unit. Once again, this unit is inserted in, or provided in conjunction with, a plate 330, of poor heat conductivity. Again, the plate contains an opening 323 for the insertion of the pin 321 on the handle 303 of the carbonator 61. The electrical cooling unit includes, below a plate 335 of good heat conductivity, a plurality of thermoelectric cooling units 337. The nature of these units is that there is a temperature gradient established between the opposing side when electrical current is passed through them. The thermoelectric units, which are essentially of a plate-like material, have their cold side abutting against the plate 335. Attached to their warm side are heat sinks 339. Below the heat sinks, a fan 341 is mounted for establishing a flow of cooling air to remove heat from the heat sinks. Power is supplied to the fan and to the thermoelectric cooling units 337 by means of the power line 343. The circuit of this unit is described below in connection with FIG. 15. When operating with such a unit cool air is drawn through openings 345 (FIG. 14) below the fan, warm air is exhausted through the openings 57 and 59 shown on FIGS. 12 and *2b*.

Figure 15:
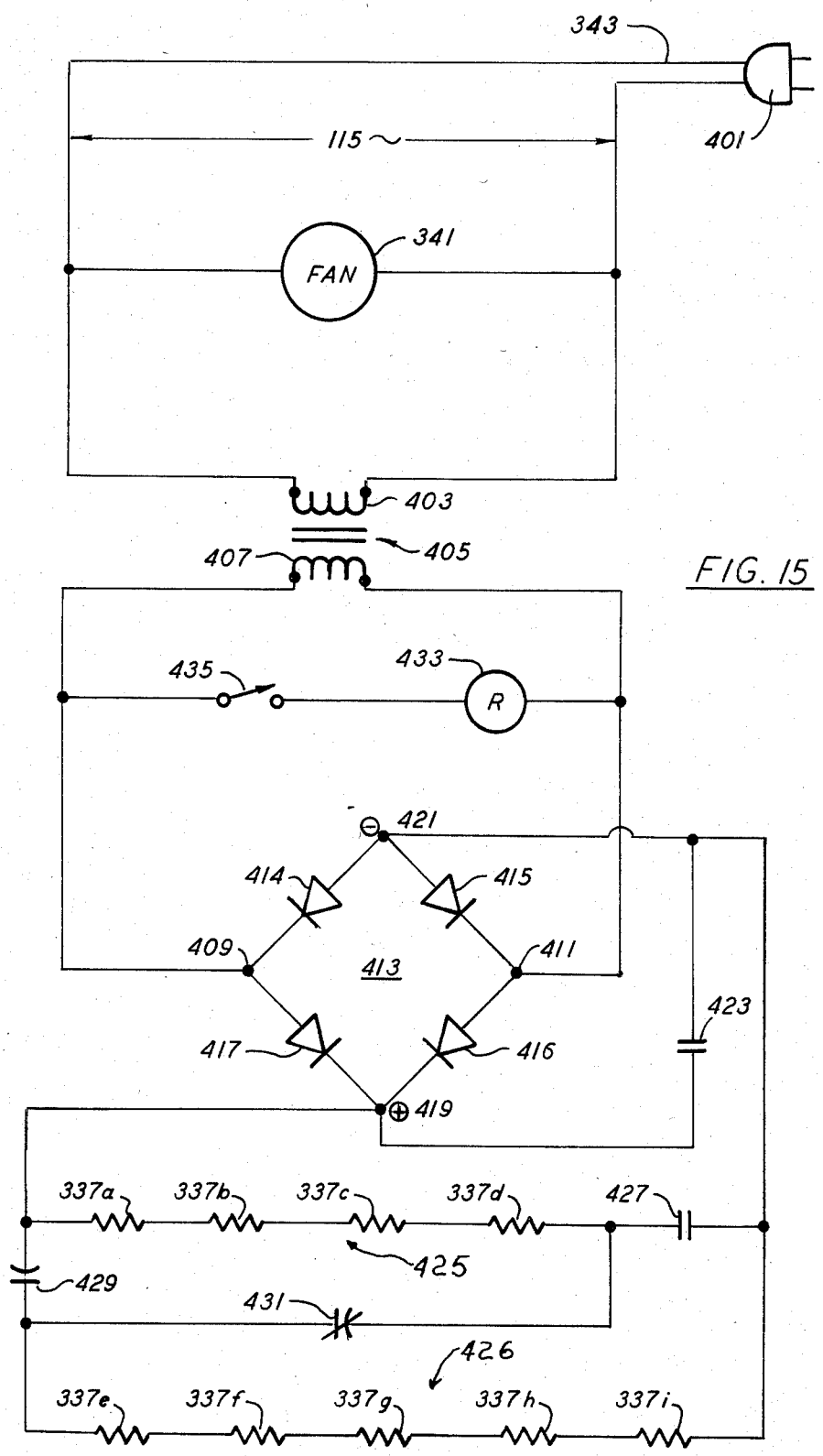
FIG. 15 is a schematic diagram of the cooling system of FIG. 14.

FIG. 15 is a schematic diagram of the circuit for the thermoelectric cooling elements 337 of FIG. 14. The power supply cable 343 has on its end a plug 401 to be plugged into a conventional outlet to supply power at the line voltage to the cooling system. Fan 341 is coupled across the two sides of the AC power line 343. Also coupled across the line is the primary 403 of a transformer 405. The secondary 407 of transformer 405 is coupled to two diagonals 409 and 411 of a full wave rectifier bridge 413 comprising diodes 414–417. At the other two diagonals 419 and 421 of the bridge, rectified DC, at approximately 18 volts is taken off. A capacitor 423 is placed in parallel across the diagonals 419 and 421 to filter the DC voltage. The plurality of thermoelectric cooling elements 337 are arranged in series in two groups. The first group 425 comprises the elements 337*a–d* in series, and the second group 426 elements, 337*e–i*, in series. The free end of the thermoelectric element 337*a* in group 425 is connected to the bridge terminal 419. The free end of the element 337*d* is coupled through a normally open relay contact 427 to the opposite diagonal 421 of bridge 413. The other group 426 has its one end, the free end of element 337*i*, coupled to the terminal 421 of the bridge 413, and its other end, the free end of element 337*e* coupled through a second set of normally open contacts 429 to the terminal 419 of the bridge. The end of the element 337*e* coupled to the contacts 429 is also coupled through a set of normally closed relay contacts 431 to the end of the element 337*d* coupled to the contacts 427. Contacts 427, 429 and 431 are operated by a relay coil 433 which is connected across the secondary 407 of transformer 405 in series with a switch 435.

In operation, once the plug 401 is plugged into an appropriate wall outlet and power is being supplied over the power line 343, the fan 341 will immediately begin operating. The line voltage applied across the primary 403 of transformer 405 will be stepped down to approximately 12 volts which will then be rectified in the bridge 413 to provide a DC voltage of approximately 18 volts at the output terminals 419 and 421 of the bridge. This DC voltage will be smoothed and filtered by the capacitor 423. The polarity of the DC voltage is positive at the terminal 419 and negative at the terminal 421. The thermoelectric elements 337*a–337i* are appropriately poled in accordance with these polarities. In the condition shown, with the switch 435 open, the relay 433 will not be energized. Thus, contact 431 will be closed and the contacts 427 and 429 opened as shown. The DC voltage will flow from the terminal 421 through the series circuit 425, through the closed relay contact 431, and the series circuit 426 back to the terminal 419. In other words, in this condition, all of the thermoelectric elements 337*a–337i* are in series across the output of bridge 413. The nature of the thermoelectric elements is such that their degree of cooling is proportional to the current. Furthermore, the elements are resistive in nature. Thus, with all elements in series, the current which is determined by the sum of the resistances will flow. Typically, this current is approximately 8 amps. This establishes a first, lower level of cooling.

When the switch 435 is closed, the relay 433 is energized opening contact 431 and closing contacts 427 and 429. As a result, the two series circuits 425 and 426 are now connected in parallel across the output terminals 419 and 421 of the bridge 413. The current flowing through each of the two parallel branches comprising the series circuits 425 and 426 will now be determined by the number of elements in each of the series circuits. Since this is a smaller number in each case than when all elements were connected in series, greater currents will flow in each of the two parallel branches. This will then result in a greater cooling effect. The thermoelectric cooling elements can be of the type manufactured and sold by Cambion Electric, Cambridge, Mass.

Figure 19:
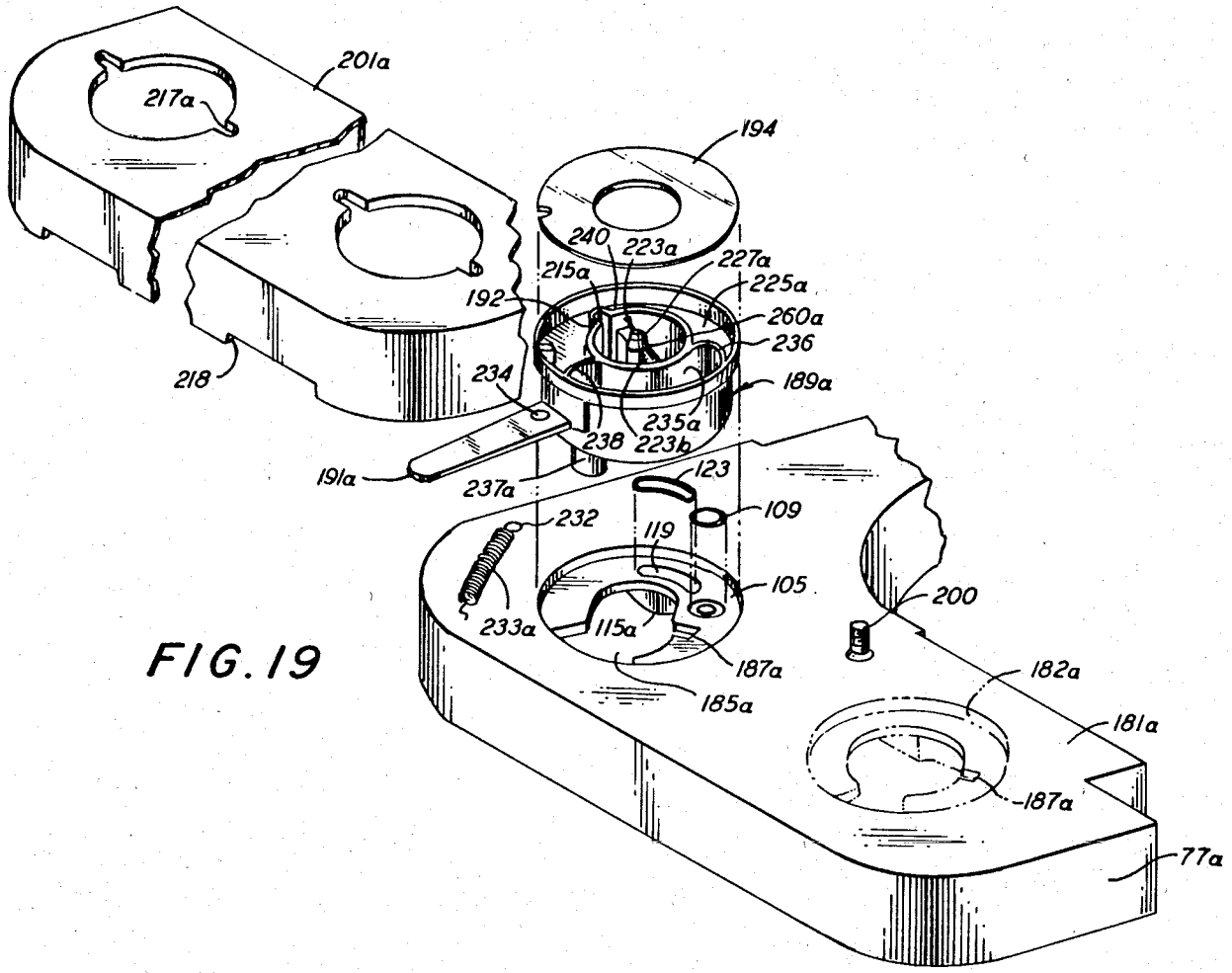
FIG. 19 is an exploded perspective view of a preferred embodiment of rotary valve for use in the present invention.
Figure 20:
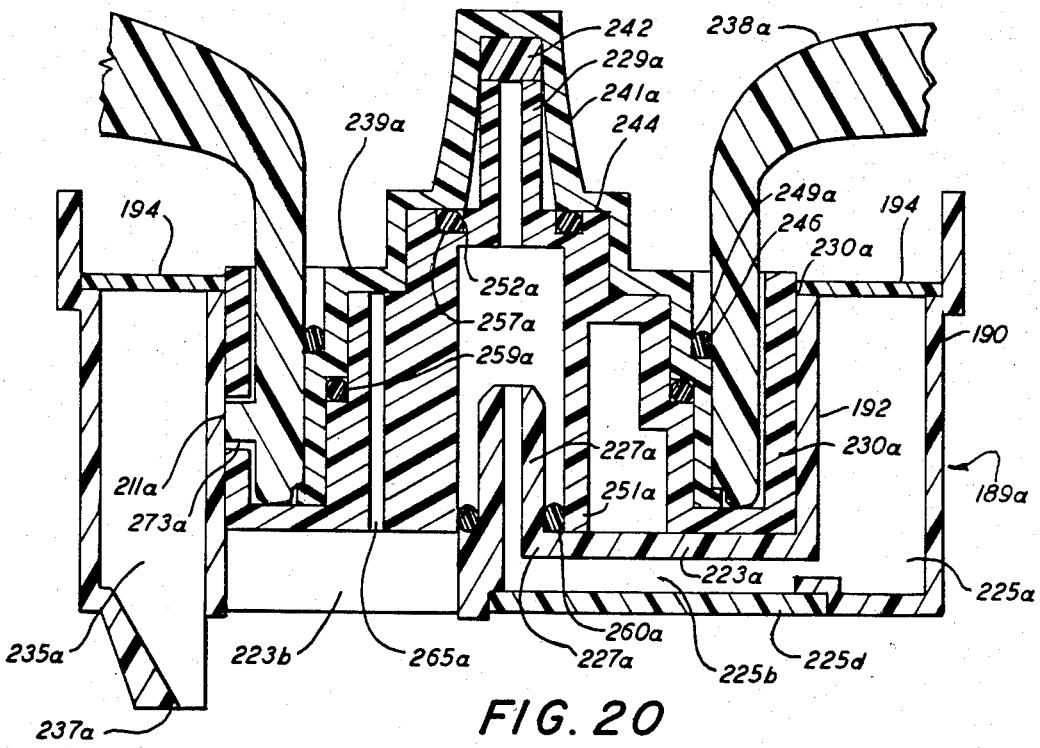
FIG. 20 is a cross sectional view through a rotary valve according to FIG. 19 and through an improved form of container valve according to the present invention.

FIG. 19 shows an improved form of valve and manifold according to the present invention. The arrangement is essentially the same as that shown in FIG. 6. The embodiment of FIG. 19, however, is adapted for easier molding and is also adapted to be used with an improved form of valving mechanism in the container. Manifold 77*a* contains appropriate bores 182*a* to receive the rotating valve members 189*a*. As in the previous embodiment, an inlet opening 105 for the diluent surrounded by an O ring seal 109 and an inlet opening 119 for the carbon dioxide surrounded by an O ring seal 123 are provided. The passages leading to the outlets 105 and 119*a*, portion of the passage 115 a being visible in FIG. 19 are molded into the manifold 77 such that they are of U shaped cross section. They are then enclosed by an appropriate cover piece which is bonded into place. The same scheme is utilized in forming passages 225*a* and 235*a* in the central rotating valve member 189*a* as will be seen below. A central opening 185*a* through which the spout 237*a* extends for dispensing diluent and also from which the concentrate can be dispensed is provided as in the previous embodiments. Also included is a drainage slot 187*a* performing the same function as the drainage slot 187 of FIG. 6. As can be seen from FIG. 19 and FIGS. 20 and 21, the rotating valve member is molded to be cup-like with an outer cylindrical wall 190 which rotates within the opening 182*a*. Concentric therewith is an innerwall 192 which forms the opening in which the cap of the container is inserted, as best seen in FIG. 20. Inner wall 192 contains a slot 215*a* therein in which the tab 213*a* on a cap 230*a* is inserted. As previously explained, as the central rotatable member is rotated by means of a handle 191*a*, the cap will rotate therewith. Diposed over the base 181*a* and the rotatable central valve members 189*a*, and retaining them in place is a cover 201*a* having slots 218 to permit the handles 191*a* to extend therethrough. The cover contains a central opening in which diametrically opposed slots 217*a* are formed to engage tabs on the neck of the container. These take the place of the similar slots 217 in the adjustment disc of FIG. 6. In the present embodiment, adjustment by means of an adjustment disc is not carried out. Rather, all adjustment to take care of temperature variations or the like can be done by controlling pressure or by using temperature sensitive means in the outlet passage. Within the central valve member 189*a* between the walls 190 and 192, the expansion chamber 235*a*, for the diluent is formed by two curved walls 236 and 238 respectively. This chamber communicates with the spout 237*a*. The inlet to the chamber is through an inlet opening 235*b* best seen on the bottom plan view of FIG. 21. When in the proper position, this overlies the diluent outlet 105. The wall 236, along with a wall 240 form the carbon dioxide chamber or passage 225*a*. Carbon dioxide from the outlet 119 enters through an inlet opening 225*c* and flows from the chamber 225*a* into a chamber 225*b* which is formed in a strut 223*a* which extends from the wall 192. This terminates in a central cyclindrical member 227*a* which is adapted to be inserted into the central opening in the cap. An additional solid strut 223*b* helps support the member 227*a*. Member 227*a* is surrounded by an O ring seal 260*a*. In order to fully enclose the chambers 225*a* and 235*a*, a cover 194 is provided which is welded in place onto the rotatable valve member 189*a* so as to seal against walls 190 and 192 along with partitions 236, 238, and 240.

Biasing of rotatable valve member 189*a* is by means of a spring 233*a* and a suitable post 232 on the base 181*a*. This biases the handle to the left as seen in FIG. 19 so that neither opening 225*c* nor 235*b* are overlying their respective outlets 119 and 105. In this embodiment, there is no vent position. Rotation of the handle 191*a* to the right results in the opening 225*c* first coming to overlie the slotted opening 119, whereafter, with continued rotation, the opening 235*b* will overlie the outlet 105. In the present embodiment the container, when removed from the machine, remains pressurized. Thus, venting is not required.

Other than the lack of venting, and the lack of an adjustment disc, the embodiment of FIG. 19 is functionally identical to that of FIG. 6. The changes are made simply to facilitate molding of the parts and to avoid the need to carry out machining. The channel 225*b* is closed off by a cover member 225*d* shown in FIG. 20 but not in place in FIG. 21. In this way, the major portion of the central valve number 189*a* can be molded whereafter the cover 194 can be put in place along with the cover or insert 225*d*, both sealed in place so as to provide the necessary chambers. Similar techniques are used in molding the manifold 77*a* so as to form various needed passages such as the passage 105*a*.

Figure 21:
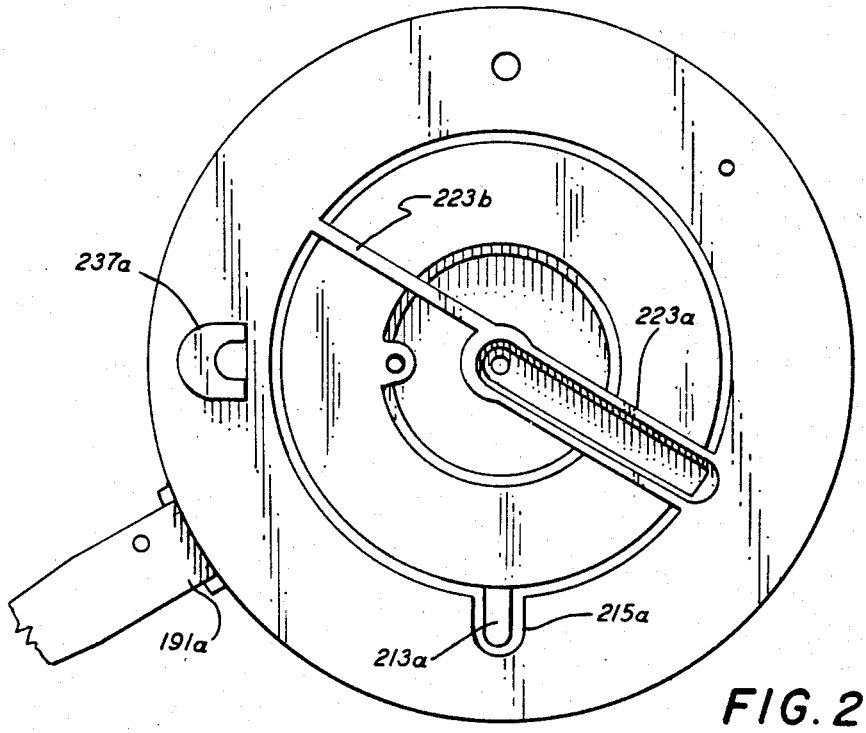
FIG. 21 is a bottom plan view of the arrangement of FIG. 20.

FIGS. 20 and 21 also show a preferred valving arrangement for the container. In the embodiment previously disclosed, the rate of concentrate dispensing was controlled by the amount of rotation. In the embodiment of FIGS. 20 and 21, the basic control of the amount of concentrate being dispensed is by means of the size of the opening 265*a* through the cap. This will be sized according to the type of concentrate being dispensed. For example, diet soda concentrate is much less viscous than syrups containing sugar. Thus for diet concentrates the diameter of the bore opening 265*a* will be much smaller. Furthermore, various types of check valves, which were previously tried, failed to adequately seal against leakage of a diet concentrate. For this reason, the embodiment of FIG. 20 uses a positive shutoff valve rather than a check valve. As before, the cap is formed with a central bore into which the gas outlet 227*a* is inserted and sealed by means of the O ring seal 260*a*. This opening communicates with a tube 229*a*. In the previous embodiment, this was a dip tube which contained in it a check valve. In the present embodiment, this tube, which has a flat end, seals against a cylindrically shaped seal member 242 preferably made of food grade silicone rubber. The cap can be made of polypropylene or low density polyethylene as may the plug 239*a* which is inserted into the neck of the container 238*a*. The cylindrical plug 242 is retained in a projecting portion of the plug made of four equally spaced ribs 229A. The ribs extend from an annular surface 244. Annular surface 244 seats against an O ring 252*a* retained in a slot in the cap. This prevents any of the concentrate, which will be surrounding the ribs 229*a*, from getting past this sealing point. In addition, a further O ring seal 246 prevents leakage from the joint between the insert 239*a* and the bottle 238*a*.

In operation, as previously, rotation of the cap 230*a*, which contains slots 273*a* in which tabs 211*a* on the bottle 238 are inserted, the slots 273*a* being slanted as shown in FIG. 11A, results in the movement of the cap 230*a* with respect to the insert 239*a*. This simultaneously causes the tube 229*a* to separate from the cylindrical seal 242 to permit pressurizing gas to reach the interior of the container, and moves the annular part 244 away from the O ring seal 252*a*. As a result, flow of the concentrate can reach the outlet 265*a*. To prevent concentrate from escaping from below that point an additional O ring seal 259*a* is provided between surfaces of the insert 239*a* and the inner portion of the cap 230*a*. As these two surfaces move with respect to each other, the O ring seal maintains a seal therebetween. In this embodiment, when the container is first used, there will not be an elevated pressure in the container until the cap is first rotated to open the valve formed between the tube 229*a* and the member 242. However at the same time as pressurizing takes place dispensing will commence since a passage to the outlet 265*a* will be opened. This of course only occurs on the first drink. It was thought that there might be some deterioration in quality in this first drink. However, tests have shown that there is no noticeable difference even on the first drink of, fore example, 200 ml. This due to the fact that the pressurizing gas enters more quickly than the concentrate leaves. The sealing arrangement shown in FIG. 20 has been found to be particularly effective with all types of syrups. Although in the present embodiment, the seal at the tube 229A is against a member made of silicon rubber, by using plastic materials of different hardness for tube 229A and the insert, it is possible for the seal to be molded right into the insert. The central rotatable valve member can be made of Delrin, an Acetal homopolymer with the lid 201*a* and base 181*a* made of ABS plastic. With the low viscosity of diet syrups, it has been found that a reduced pressure of one PSI is preferred in the container. By proper sizing of the outlet 265*a* along with this pressure, both diet and regular drinks can be dispensed. Furthermore, the tolerances established in the industry for drinks of this nature are maintained over an adequate range of temperatures without further adjustment.

Figure 23:
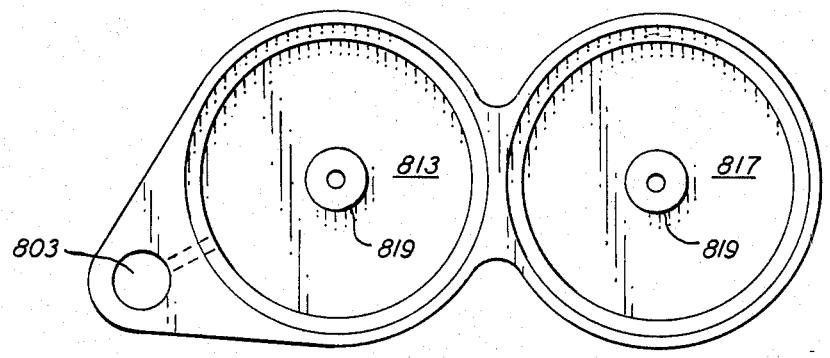
FIG. 23 is a plan view of the diffusor of FIG. 22.
Figure 22:
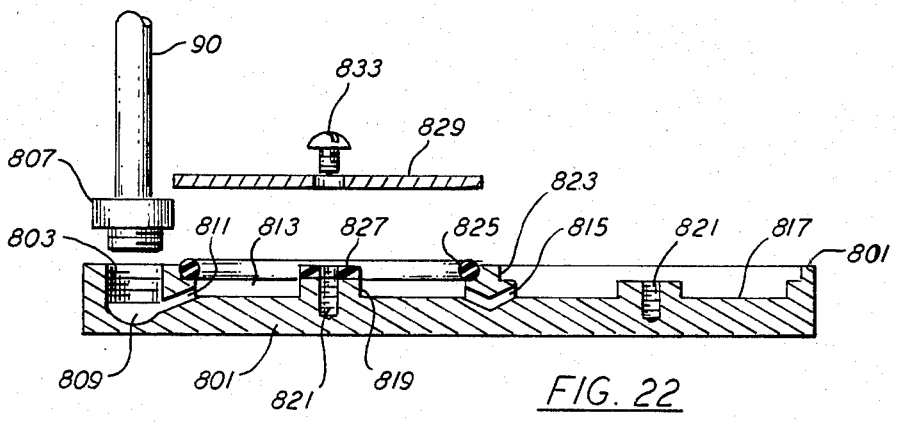
FIG. 22 is an exploded elevation view, partially in cross-section, of a form of diffusor.

FIGS. 22 and 23 show a new form of diffuser. The diffuser includes a base 801 containing an inlet fitting 803 in which the line 90 from coupling 89 or 89A (see FIG. 12) is fitted and sealed in conventional fashion with a nut 807. The fitting opens into a chamber 809 communicating through a passageway 811 with a cavity 813 which, in turn, communicates through another passageway 815 with another cavity 817. As seen from the plan view of FIG. 23, there is, in the center of each of the cavities, which are of cylindrical cross-section, a raised area 819 containing a threaded hole 821. Also, there is recess 823 formed in each of the cylindrical spaces 813 and 817. The recess 823 receives an O-ring 825. A sealing washer 827 overlies the raised area 819. Shown in exploded view above this area is a sintered plate or sintered disc having thickness of approximately 1/16th of an inch and a 2-inch diameter. One is provided over each of the two cavities 813 and 817. A stainless steel machine screw 833 is provided for securing the disc onto the body and covering the cavities 813 and 819. The disc is made of sintered stainless steel having a maximum 5-micron passage size. This diffuser has been found to be particularly efficacious in carrying out carbonation. The removable disc permits disassembly of the difusser for purposes of cleaning and hygiene. Preferably cavities 817 and 813 are shallow to permit gas entering therein to entrain water which collects in the cavities thereby wetting the pores of the diffuser and improving gas diffusion characteristics.

Figure 26:
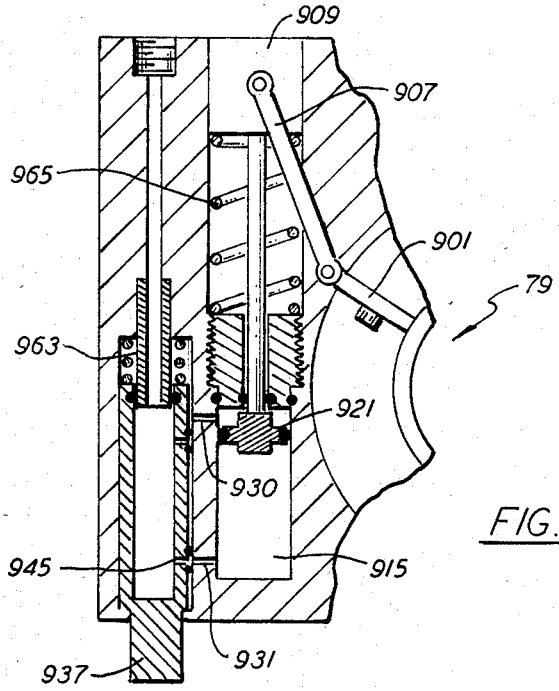
FIG. 26 is a cross sectional plan view of the actuator of FIG. 24 showing the valve in the closed position.
Figure 24:
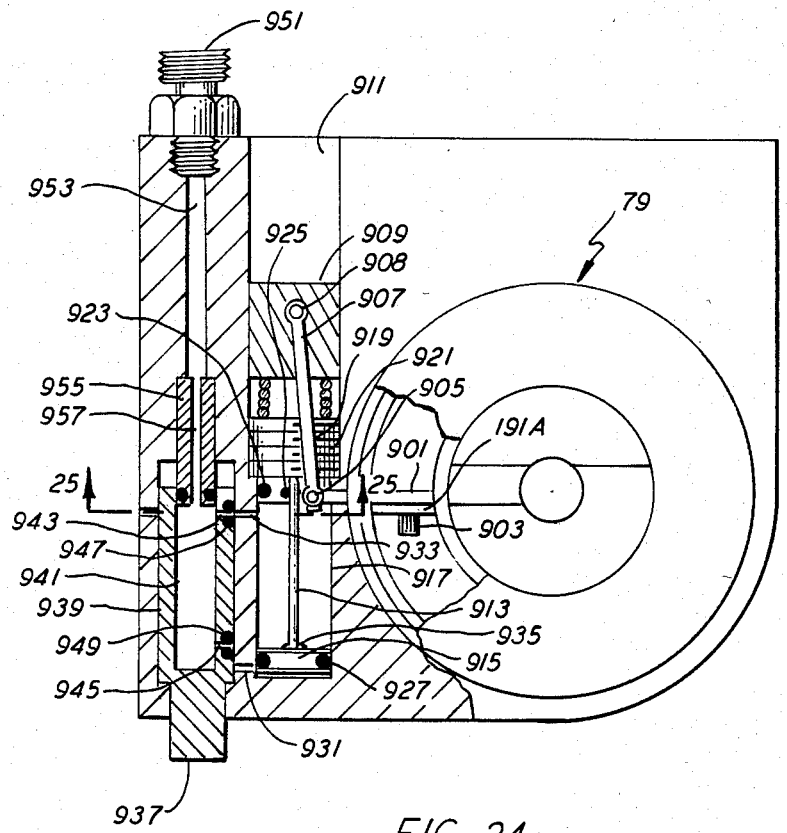
FIG. 24 is a plan view, partially in cross section, of a pneumatic actuator for operating a rotary valve according to the present invention, showing the valve in the open position.
Figure 25:
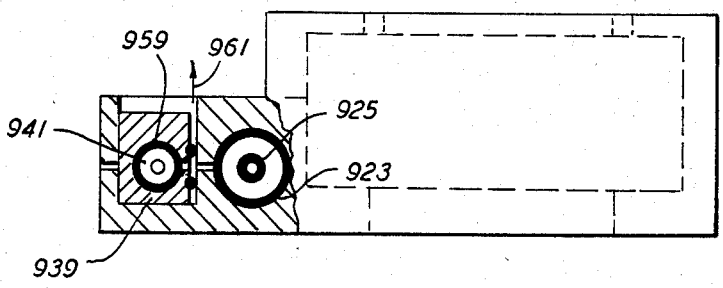
FIG. 25 is a section along line 25—25 of FIG. 24.

FIGS. 24–26 illustrate a pneumatic actuator for the valve 79 of FIG. 4 or FIG. 19. For this purpose, a portion of a linkage 901 is connected by means of a screw 903 to a portion corresponding to the actuating lever 191 of FIG. 4. Portion 901 of the linkage is coupled through a joint 905 to another linkage arm 907 connected through joint 908 to a movable block 909. Block 909 is contained within a suitable bore 911 and is coupled by a rod 913 to a piston 915 disposed in a cylinder 917. The end of the cylinder 917 adjacent to block 909 is sealed by a plug 919 which has a projection 921 at its end inserted into the cylinder and sealing thereagainst with an O-ring 923 between the cylinder wall and the plug. Another O-ring 925 seals against the rod 913 attached to the piston. The piston, itself, seals against the cylinder 917 by means of another O-ring 927. Cylinder 917 has an inlet at each end, thus, there is an inlet 931 and an inlet 933. To insure that with the piston 915 at its end positions there is a space for gas to be admitted to the cylinder, raised areas 935 are formed at each of the piston. In the position shown in FIG. 24, gas is admitted through the passage 933, driving the piston 915 to one end and operating valve 79 to dispense. This is accomplished by pressing a button 937 extending through an opening in the manifold. Button 937 is an extension of a rectangular member 939 containing a cylindrical chamber 941. Member 939 slides in a suitable recess formed in the manifold. There are two outlet passages from chamber 941—an outlet 943 and and outlet 945 and in the position shown the outlet 943 is aligned with passage 933, the junction between sealed with an O-ring 947. Similarly, there is an O-ring 949 surrounding the passage 945. Passage 931 is venting to the atmosphere because of small gap between the member 939 and the opening in the manifold. Carbon dioxide at the same pressure as is used in the carbonator, is supplied through a fitting 951 screwed into a suitable threaded bore in the manifold through a passage 953 to a connecting piece 955 which is press-fitted into the manifold. Connecting piece 955 contains a central bore 957 which is in communication with the cavity 941 in the member 939. As illustrated by FIG. 25, the cavity 941 is of cylindrical cross-section and seals against the connecting tube 955 by means of an O-ring seal 959. Also visible in this view are the seals 925 and 923 sealing the cylinder 915. When the button is release, because of the carbon dioxide pressure in the cavity 941, the button will move outwardly to the position shown in FIG. 26. Now, the passage 945 is aligned with the passage 931 and carbon dioxide is admitted to the other end of the cylinder 915 acting on the other side of piston 921 to immediately drive the piston and with it the block 909, thereby moving linkages 907 and 901 to the position shown to close the dispensing valve 79. The cylinder 915 on the other side of the piston 921 vents through the passage 933 and the gap formed between member 939 and the recess in the manifold as indicated by arrow 961 of FIG. 25. To prevent the button 937 and more importantly the block 909 and its associated linkage from remaining in an operating position due to the loss of carbon dioxide pressure, spring biasing is also provided. Thus, there is a spring 963 biasing the member 937 outwardly into the closed position. Similarly, a spring 965 biases the block 909 outwardly to move the valve to the closed position.

The diameter of cylindrical chamber 941 should be kept small to minimize the force needed to push button 937. The diameter of cylinder 915 should be as large as practical taking into consideration the loss of gas on each operation. The pneumatic arrangement provides a snap action on and off control preventing the valve being partially on or off so as to maintain a high quality drink.

What is claimed is:

1. A manifold for use with a beverage dispenser comprising:

(a) a manifold body comprising:

(1) a first passage, formed in said body, having an inlet, for connection to a source of pressurizing gas and an outlet adapted to be coupled to a diluent supply, to provide pressurization thereof;

(2) a second passage, formed in said body, having an inlet adapted to be coupled to the diluent supply and an outlet adapted to be coupled to a dispensing valve;

(b) fittings extending from the outlet of said first passage and inlet of said second passage in parallel spaced relationship adapted to mate with mating fittings of diluent supply;

(c) first and second check valves in said fittings, whereby pressurization within said manifold will be maintained when the diluent supply is disconnected from said manifold;

(d) a first pressure reducing valve disposed in said body;

(e) a third passage in communication with said first passage for supplying said source to the inlet of said pressure reducing valve; and (f) a fourth passage for coupling the outlet of said first pressure reducing valve to pressurize a concentrate source.

2. A manifold according to claim 1 and further including bores formed in said body at the outlet of said first passage and the inlet of said second passage, said fittings comprising tubular fittings disposed in said bores.

3. A manifold according to claim 1, wherein said body is of a plastic material.

4. A manifold according to claim 4, wherein said body is a block of plastic material.

5. A manifold according to claim 1 and further including a dispensing valve having inlet coupled to said second and said fourth passages.

6. A manifold according to claim 5 wherein said dispensing valve is integrally attached to said manifold.

7. A manifold according to claim 5 and further including bores formed in said body at the outlets of said second and said fourth passages and tubular fittings disposed in said bores for coupling said dispensing valve to said manifold.

8. A manifold according to claim 6 wherein said dispensing valve is remotely disposed and further including tubing coupling said remote dispensing valve to said tubular fittings.

9. A manifold according to claim 5 wherein said dispensing valve comprises:

(a) a first member containing therein a cylindrical bore extending partially through said member, said fourth passage in said manifold coupled to an elongated outlet in said cylindrical bore, said second passage coupled to a further outlet in said cylindrical bore, the bottom of said bore containing an open area through which concentrate can be dispensed;

(b) O-ring seals surrounding said elongated and said further outlet;

(c) a rotatable valve member of generally annular shape disposed for rotation within said cylindrical bore with said valve member having a periferal portion sealing against said O-ring seals, said rotatable valve member having thereon a diluent dispensing outlet;

(d) means for bringing about a relative rotation between said first member and said rotatable valve member;

(e) means in said rotatable valve member for engaging a first concentrate container part;

(f) a diluent passage within said rotatable valve member for coupling the dispensing outlet in said rotatable valve member with said further outlet when said rotatable valve member is rotated to a pre-determined position;

(g) a cover member sealed to said first member forming therewith a casing for retaining said rotatable valve member in place;

(h) means in said casing for engaging a second container part; and (i) means in said rotatable valve member for coupling said elongated outlet to one of the container parts to pressurize the container.

10. A manifold and valve according to claim 9 wherein said means for engaging are disposed for rotation with respect to said casing and further including means for rotating said means for engaging within said casing over a limited angular range, said means for rotating, when not operating to rotate, holding said means for engaging fixed with respect to said casing.

11. A manifold and valve according to claim 10 wherein said means in said casing comprise an annular adjusting disc, said disc having at least one slot on the inside thereof.

12. A manifold according to claim 11 wherein said means for rotating comprise: means supported in said cover including an extending knob which may be grasped by the hand; a shaft extending from said knob having thereon a worm gear; and mating gears on said adjusting disc engaging said worm gear, whereby rotation of said shaft by said knob will result in rotation of said adjusting disc.

13. A manifold according to claim 9 for use with a supply of concentrate which comprises, a container having a bottle portion with a neck and a cap portion rotatable thereon, a concentrate dispensing valve within said container, cooperating surfaces on said cap and bottle neck for converting a rotary motion of said cap into a linear motion to open and close said valve and a dispensing outlet opening in the top of said cap, said cap being said first container part and said bottle, said second container part, said container inserted into said valve such that said cap engages in said means for retaining in said rotatable valve member, and said bottle engages said means in said casing and said outlet opening is over an open area with said container in an inverted position.

14. A manifold according to claim 13 wherein said diluent dispensing outlet is a spout directed at an angle to the vertical such as to intersect with a downward flow of concentrate from the concentrate outlet in said cap, whereby said diluent and concentrate will mix while being dispensed.

15. A manifold according to claim 9 wherein first and second valves are provided each integrally supported on said manifold, said second and said fourth passages having outlets at each of said first and said second valves.

16. A beverage dispenser comprising:

(a) a manifold comprising: a manifold body; said manifold body comprising; a first passage having an inlet adapted for connection to a source of pressurization and an outlet for supplying said source of pressurization to a supply of diluent and a second passage having an inlet adapted to be coupled to the diluent supply and an outlet adapted to be coupled to a dispensing valve;

(b) a source of pressurizing fluid coupled to the inlet of said first passage;

(c) means for containing a supply of concentrate;

(d) a diluent tank for containing diluent having disposed thereon a quick disconnect coupling with fittings for coupling to a pressurization inlet line and diluent outlet line, each of said fittings containing a check valve;

(e) mating fittings at the outlet of said first passage and the inlet of said second passage mated with said fittings in said tank to permit quick connect and disconnect between said diluent tank and said first and said second passages, said mating fittings operable to open said check valves when said fittings are connected; and (f) a dispensing valve which when operated causes said concentrate and said diluent to be dispensed at controlled flow rates into a container to provide a beverage, coupled to simultaneously dispense concentrate from said means for containing and said diluent from said second passage, said dispensing valve being integrally attached to said manifold.

17. A dispenser according to claim 16 and further comprising:

(a) a first pressure reducing valve disposed in said body;

(b) a third passage in communication with said first passage for supplying said source to the inlet of said pressure reducing valve; and (c) a fourth passage for coupling the outlet of said first pressure reducing valve to pressurize a concentrate source.

18. A dispenser according to claim 16 and further including check valves in said mating fittings in said manifold said check valves adapted to be opened only in response to connection of said manifold and tank whereby pressurization within said tank and within said manifold will be maintained when said tank is disconnected from said manifold.

19. Apparatus according to claim 18 wherein the check valve in said gas line on the manifold side comprises a Schrader valve.

20. Apparatus according to claim 19 wherein said check valve in said coupling in said carbonator tank for the gas tank comprises an elastic sleeve.

21. Apparatus according to claim 19 wherein said check valve in said coupling in said carbonator tank for the gas passage comprises a duckbill valve.

22. Apparatus according to claim 18 wherein the check valves in water lines on both the manifold and carbonator side, each comprise a valve core including a cylindrical stem portion of a first, smaller diameter; a conical section at the base of said stem section; and a partially cylindrical section, said partially cylindrical section having formed therein on each side thereof a pair of cuts of cylindrical cross-section, one of said pairs of cuts being directed inwardly and toward the bottom of said partially cylindrical portion, and the other pair being directed toward the top thereof and intersecting the base of said conical section to provide smooth flow passages; an O-ring for sealing against said conical section; a spring for biasing the conical section of said valve core against the O-ring; and means for retaining said O-ring, core and spring together with said spring biasing said core against said O-ring.

23. A dispenser according to claim 16 wherein said dispensing valve is adapted to separately dispense said concentrate and said diluent in such a manner that mixing of said concentrate and said diluent occurs only after leaving said dispensing valve.

24. A dispenser according to claim 17 wherein said coupling in said tank includes two essentially parallel bores and wherein said mating fittings in said manifold comprise two parallel tubular stubs inserted into said bores and sealingly engaging with said bores.

25. A dispenser according to claim 16 wherein said diluent comprises carbonated water and wherein said pressure fluid comprises carbon dioxide gas and further including means in said diluent tank for carbonating water therein, said means coupled to the bore in said coupling associated with said first passage.

26. A dispenser according to claim 25 wherein said means for carbonating comprise: a diffuser disposed near the bottom of said tank; a conduit extending between said diffuser block and said coupling to supply carbon dioxide thereto; and a restricter to control flow of carbon dioxide therethrough.

27. A dispenser according to claim 26 wherein said diffuser comprises:

(a) a base member having therein a cavity open on the top;

(b) means coupling said cavity to said conduit;

(c) a sintered metal disc having a maximum pore size of about 5 microns disposed over said cavity; and (d) means holding said disk tightly against said cavity, in a sealing manner.

28. A dispenser according to claim 27 wherein said base member includes:

a threaded bore for coupling to said conduit;

a passage in said base between said bore and said cavity;

a recess at the top of said cavity for an O-ring seal;

a projection in the center of said cavity with a tapped hole;

a hole in the center of said disk; and a machine screw passing through said hole and threaded into said tapped hole holding said disk tightly against said O-ring.

29. A dispenser according to claim 28 and further including a further identical cavity and further disk, and a passage in said body between said cavity and further cavity.

30. A dispenser according to claim 16 wherein said diluent tank includes a body for containing said diluent having an opening in the top thereof and a cover for closing said opening and further including means for relieving the pressure in said tank to permit removal of said cover to refill said tank.

31. A dispenser according to claim 30 wherein said means for relieving the pressure comprise a valve disposed in said cover and means on said cover for operating said valve.

32. A dispenser according to claim 31 wherein said valve in said cover comprises: a valve seat disposed in said cover; a valve member adapted to contact said seat, said valve member disposed at the end of a plunger extending through said cover; means biasing said valve member against said seat; and a handle on top of said cover coupled to said plunger said handle supported for rotation so as to move said plunger to lift said valve member from said seat to permit pressure relief within said tank.

33. A dispenser according to claim 32 wherein: said tank body contains in a recess in the top thereof, means formed at the bottom of said recess and in said cover for bringing and retaining said cover and recess into sealing engagement; and said handle extends beyond the circumference of said cover; and further including: a cutout in the top of said tank body for accepting the portion of said handle which extends beyond said circumference when said cover is in place, whereby said cover cannot be disengaged until said handle is lifted to relieve the pressure on said tank.

34. A dispenser according to claim 31 and further including a sealing gasket disposed between said cover and the top of said tank.

35. A dispenser according to claim 34 wherein said sealing gasket is disposed between matching circumferential surfaces of said cover and the said tank top.

36. A dispenser according to claim 24 wherein said coupling is mounted on one side of said tank said bores thereby extending essentially in a radial direction and further including means on the other side of said tank for preventing movement of said tank after said quick disconnect connection is made.

37. A dispenser according to claim 36 wherein said dispenser further includes: a base portion to which said manifold is mounted; means on said base having a horizontal supporting surface for supporting said diluent tank such that said coupling mates with the fittings on said manifold; a hole in said supporting surface on the side opposite said coupling; and wherein said means for retaining comprises: a pin mounted to the opposite side of said tank from said coupling; and means for selectively inserting and removing said pin from a said hole in said supporting surface.

38. A dispenser according to claim 37 wherein said means for inserting and removing comprise a collapsible handle mounted to said tank, said handle comprising a U-shaped bracket vertically disposed on said tank on the side opposite said coupling having elongated slots in its legs near the bottom thereof, a first handle portion hinged to the top of said bracket, a second handle portion having one end hinged to said first handle portion and another end pinned to said elongated slots at the bottom of said U-shaped bracket, said pin hinged to said other end of said second handle part, whereby movement of said handle to a collapsed position will result in a downward movement of said pin into the hole in said supporting means and extension of said handle will result in an upward movement of the other end of said second handle part in said slot to cause removal of said pin and the availability of a handle which can be grasped by a user to remove said tank from said dispensing device.

39. A dispenser according to claim 37 wherein said means for supporting said tank include means for effecting a heat transfer with respect to said tank.

40. A dispenser according to claim 39 wherein said means for effecting a heat transfer comprise cooling means.

41. A dispenser according to claim 40 wherein said means for supporting comprise: a rectangular frame; an insulating plate of a conducting material with low thermal conductivity having a central opening therein supported at the top of said rectangular frame; and a plate of material of good heat conductivity covering said central opening in said insulating plate, said tank disposed on said conducting plate, and wherein said means for cooling comprise cooling means in contact with the other side of said conducting plate.

42. A dispenser according to claim 41 wherein said means for cooling comprise a sealed pan containing therein a liquid material with a high latent heat of fusion, the top of said pan being said conducting plate, the remainder of said pan being enclosed within said rectangular housing below said insulating plate and further including insulation surrounding said pan in the space between the periphery of said frame and said pan, said pan adapted to be removed from said rectangular frame whereby it may be placed in a freezer to freeze the material therein, whereby said material can then absorb heat from said tank.

43. A dispenser according to claim 42 wherein said pan is of a shape to fit in said hole, said pan having a lip at the top thereof at the location of said conductive plate whereby said lip will be supported by said insulating plate.

44. A dispenser according to claim 41 wherein said cooling means comprise: thermoelectric cooling means disposed on the side of said conducting plate opposite the side supporting said tank and further including: heat sink means in contact with the side of said thermoelectric elements opposite the side in contact with said conducting plate; a fan for cooling said heat sink; and ventilation openings in said rectangular frame to permit warm air to be exhausted therefrom.

45. A dispenser according to claim 41 and further including a cover surrounding said tank, said cover supported on said base.

46. A dispenser according to claim 45 wherein said base includes a base plate and a central upstanding portion having formed thereon a lip and wherein said cover is adapted to engage said lip and rest on said base.

47. A dispenser according to claim 46 and further including insulation disposed on the inside of said cover.

48. A dispenser according to claim 47 wherein said carbon dioxide tank is disposed on the side of said upstanding portion opposite said diluent tank and further including a second cover surrounding said carbon dioxide tank.

49. A dispenser according to claim 17 wherein said dispensing valve comprises:

(a) a bottom member integral with said manifold extending outwardly therefrom and containing therein a cylindrical bore extending partially through said bottom member, said second passage in said manifold terminating at an elongated outlet in the bottom of said bore, said fourth passage terminating in a further outlet in the bottom of said bore, the bottom of said bore also containing an open area through which concentrate can be dispensed;

(b) O-ring seals surrounding said elongated outlet and said further outlet;

(c) a central, rotatable valve member of generally annular shape so as to have a central opening disposed for rotation within said cylindrical bore with the bottom of said member resting against the bottom of said bore and sealing against said O-ring seals, said central valve member containing a central bore and having a first vertical slot therein, said member also having a diluent outlet;

(d) a member in said central bore with a partial bore formed in said member;

(e) at least one strut supporting said member in the center of said central bore;

(f) a fifth passage extending between the bottom of said central valve member and the bore in said member in said strut, the inlet of said fifth passage adapted to be brought into alignment with said elongated slot over a range of rotation of said central valve member;

(g) a sixth passage within said central valve member for coupling said further outlet in said bottom member with said diluent outlet when said central valve member is rotated to a pre-determined position within said range of rotation;

(h) means having at least one second vertical slot on the inside thereof, said first slot capable of being aligned with said second slot;

(i) a cover member for covering and retaining said central valve member in place; and (j) means for rotating said central valve member.

50. The dispenser according to claim 49 wherein said means having at least one second vertical slot comprise:

(a) an annular adjusting disc disposed over said central valve member having said second slot on the inside thereof; and (b) means for rotating said adjusting disc over a limited angular range, said means, when not operating to rotate said annular adjusting disc holding said adjusting disc fixed.

51. A dispenser according to claim 50 wherein said means for adjusting comprise means supported in said cover including an extending knob which may be grasped by the hand, a shaft extending from said knob having thereon a worm gear, and mating gears on said adjusting disc engaging said worm gear, whereby rotation of said shaft by said knob will result in rotation of said adjusting disc.

52. A dispenser according to claim 49 wherein said supply of concentrate comprises:

(a) a container having a bottle portion with a neck and a cap portion rotatable thereon, a valve seat disposed in said neck and a valve member disposed in said cap said cap having a central opening therein;

(b) a dip tube attached to said central opening and extending through said valve seat with a spacing and extending to the bottom of said bottle;

(c) cooperating camming surfaces on said cap and bottle neck for converting a rotary motion of said cap into a linear motion which will separate said valve member from said valve seat;

(d) an outlet opening in the top of said cap aligned with the concentrate opening in said bottom member;

(e) at least one tab on the neck of said bottle and a tab on said cap, said container inserted into said valve such that the tab on said cap engages in said first slot in said central valve member and the tab on said neck in said second slot in said adjusting ring with said container in an inverted position;

(f) a fitting inserted in the central bore in said cylindrical member in said central valve member; and (g) sealing means surrounding said fitting at its base, said fitting extending into said opening in said cap, said cap sealing against said sealing means, whereby, when the inlet to said fifth passage is aligned with said elongated slot pressurizing medium will be conducted through said fifth passage, said fitting and said dip tube into said container to maintain concentrate therein under a constant pressure and whereby when said central valve member is rotated in one direction the simultaneous alignment of said sixth passage with said further outlet from said fourth passage and said fifth passage with said elongated slot will occur along with a rotation of said tab on said cap with respect to the tab on said bottle to result in the opening of the valve in said container, thereby causing concentrate and diluent to be simultaneously dispensed.

53. A dispenser according to claim 52 wherein said diluent outlet includes a spout directed at an angle to the vertical such as to intersect with a downward flow of concentrate from the outlet in said cap, whereby said diluent and concentrate will mix while being dispensed into a cup.

54. A dispenser according to claim 52 and further including a diluent drain in said bottom member aligned with said sixth passage when said central valve member is not in a dispensing position.

55. A dispenser according to claim 52 and further including a check valve in said central opening in said cap and wherein said fitting is operable to open said check valve when said container is inserted in said valve.

56. A dispenser according to claim 55 wherein said check valve comprises a split seal valve which is opened by said fitting.

57. A dispenser according to claim 52 and further including a vent hole through the bottom of said bottom member, said vent hole adapted to align with the inlet to said fifth passage when said central valve member is rotated to a predetermined position, whereby said container may be vented to permit removal of said container from said valve in an unpressurized condition.

58. A dispenser according to claim 52 wherein at least first and second valves are provided each integrally supported on said manifold.

59. A dispenser according to claim 17 and further including:

(a) a second pressure reducing valve;

(b) a quick disconnect coupling for connecting said source of pressurized gas to the inlet of said second pressure reducing valve; and (c) a connecting line coupling the outlet of said pressure reducing valve to said manifold.

60. A beverage dispenser according to claim 16 and further including a pneumatic actuator comprising:

(a) a cylinder formed in said manifold;

(b) a piston disposed in said cylinder and having extending out therefrom a piston rod;

(c) valving means for selectively admitting gas pressure to opposite ends of said cylinder to act on opposite sides of said piston; and (d) means coupling said piston rod to said dispensing valve.

61. A beverage dispenser according to claim 40 wherein said valving means comprise;

(a) a member having at least one flat face containing therein a cavity;

(b) a recess in said manifold for receiving said member and permitting sliding movement of said member therein adjacent said cylinder;

(c) at least a first passage through said flat surface to said cavity;

(d) second and third passages from said cylinder to said recess entering said cylinder at opposite ends thereof;

(e) a seal surrounding said first passage;

(f) means spacing said flat face from said recess;

(g) means for admitting gas pressure to said cavity; and (h) first and second stops formed such that when engaging said first stop without any external pressure applied to said member said second passage will be in alignment to admit gas to move said piston to a position to close said rotatable valve and a second stop wherein said third passage will be in alignment to open said valve, the one of said second and third passages not admitting gas being vented to the atmosphere along said flat face.

62. A beverage dispenser comprising:

(a) a supporting base;

(b) a source of pressurizing fluid disposed on said base;

(c) a tank for containing diluent supported on said base;

(d) a dispensing valve supported on said base;

(e) at least one pressure reducing valve for said pressurizing fluid;

(f) a means having one inlet coupled to said pressure reducing valve for distributing at least said pressurizing fluid and said diluent within said dispenser, said means for distribution having at least a diluent outlet coupled to said dispensing valve;

(g) first quick disconnect means for connecting said source of pressurizing fluid to said pressure reducing valve;

(h) second quick disconnect means for connecting said diluent tank to said means for distribution to obtain therefrom pressurization and to supply thereto diluent under pressure;

(i) means containing a supply of concentrate operatively coupled to said dispensing valve, said dispensing valve adapted to cause simultaneous dispensing the concentrate and the diluent;

(j) a rectangular frame on said base;

(k) an insulating plate of material with low thermal conductivity having a central opening therein supported at the top of said rectangular frame;

(l) a conducting plate of material of good heat conductivity covering said central opening in said plate, said tank disposed on said conducting plate; and (m) cooling means in contact with the other side of said conducting plate to thereby effect heat transfer from said tank.

63. A dispenser according to claim 62 wherein said means for cooling comprise a sealed pan containing therein a liquid material with a high latent heat of fusion, the top of said pan being said conducting plate, the remainder of said pan being enclosed within said rectangular housing below said conducting plate and further including insulation surrounding said pan in the space between the periphery of said frame and said pan, said pan adapted to be removed from said rectangular frame whereby it may be placed in a freezer to freeze the material therein whereby said material can then absorb heat from said tank.

64. A dispenser according to claim 63 wherein said pan is of a shape to fit in said hole, said pan having a lip at the top thereof at the location of said conducting plate, whereby said lip will be supported by said insulating plate.

65. A dispenser according to claim 62 wherein said cooling means comprise: thermoelectric cooling means disposed on the side of said conducting plate opposite the side supporting said tank; heat sink means in contact with the side of said thermoelectric elements opposite the side in contact with said conducting plate; a fan for cooling said heat sink; and ventilation openings in said rectangular frame to permit warm air to be exhausted therefrom.

66. A dispenser according to claim 62 and further including at least one removable cover attached to said base surrounding said source of pressurizing fluid and said tank.

67. A dispenser according to claim 66 wherein said base includes a base plate and a central upstanding portion having formed thereon a lip, said tank disposed on one side of said upstanding portion, and wherein said at least one cover includes a first cover adapted to engage said lip and rest on said base plate.

68. A dispenser according to claim 67 and further including insulation disposed on the inside of said first cover.

69. A dispenser according to claim 68 wherein said source of pressurizing fluid is disposed on the side of said upstanding portion opposite said diluent tank and further including a second cover surrounding said source of pressurizing fluid.

70. A dispenser according to claim 62, wherein said dispensing valve is adapted to separately dispense said concentrate and said diluent in such a manner that mixing of said concentrate and said diluent occurs only after leaving said dispensing valve.

71. A beverage dispenser according to claim 62 and further including check valves in said second quick disconnect means for maintaining the pressure in said diluent tank and in said means for distributing when said diluent tank and means for distribution are disconnected.

72. A manifold for use with a beverage dispenser comprising:

(a) a manifold body comprising:

(1) a first passage formed in said body, having an inlet, for connection to a source of pressurizing gas and an outlet adapted to be coupled to a diluent supply, to provide pressurization thereof;

(2) a second passage formed in said body, having an inlet adapted to be coupled to the diluent supply;

(b) first and second means at the outlet of said first passage and inlet of said second passage respectively for coupling to a diluent supply;

(c) a check valve in said means at the outlet of said first passage whereby pressurization within said manifold will be maintained when the diluent supply is disconnected from said manifold;

(d) a bore in said manifold body at the outlet of said first passage, said first means for coupling comprising a tubular fitting disposed in said bore; and (e) a dispensing mechanism disposed in said manifold, comprising:

(1) a base member containing therein a cylindrical bore extending partially through said member, the bottom of said bore containing an open area through which concentrate can be dispensed;

(2) a rotatable member of generally annular shape disposed for rotation within said cylindrical bore;

(3) means for bringing about a relative rotation between said base member and said rotatable member;

(4) means in said rotatable member for engaging a first concentrate container part; and (5) means in said base member for engaging a second container part.

73. A beverage dispenser comprising:

(a) a manifold comprising: a manifold body; said manifold body comprising; a first passage having an inlet adapted for connection to a source of pressurization and an outlet for supplying said source of pressurization to a supply of diluent and a second passage having an inlet adapted to be coupled to the diluent supply and an outlet adapted to be coupled to a dispensing outlet;

(b) a source of pressurizing fluid coupled to the inlet of said first passage;

(c) means for containing a supply of concentrate;

(d) a diluent tank for containing diluent having disposed thereon a quick disconnect coupling for coupling to pressurization inlet line and diluent outlet line, said coupling containing check valves to maintain pressurization in said tank;

(e) the outlet of said first passage and the inlet of said second passage mated with said tank such as to permit quick connect and disconnect between said diluent tank and said first and said second passages; and (f) a dispensing mechanism having a fixed portion integrally formed in said manifold, which dispensing mechanism, when operated, causes said concentrate and said diluent to be dispensed at controlled flow rates into a container to provide a beverage, coupled to simultaneously dispense concentrate from said means for containing and said diluent from said second passage.

* * * * *